US011118365B2

(12) United States Patent
Segal

(10) Patent No.: US 11,118,365 B2
(45) Date of Patent: Sep. 14, 2021

(54) LIFESAVING SYSTEM AND METHOD FOR SWIMMING POOL

(71) Applicant: S.T. PRIME ENGINEERING SOLUTIONS LTD, Haifa (IL)

(72) Inventor: Elazar Segal, Hoshaya (IL)

(73) Assignee: S.T. PRIME ENGINEERING SOLUTIONS LTD., Haifa (IL)

( * ) Notice: Subject to any disclaimer, the term of this patent is extended or adjusted under 35 U.S.C. 154(b) by 35 days.

(21) Appl. No.: 16/061,231

(22) PCT Filed: Dec. 8, 2016

(86) PCT No.: PCT/IL2016/051317
§ 371 (c)(1),
(2) Date: Jun. 11, 2018

(87) PCT Pub. No.: WO2017/098515
PCT Pub. Date: Jun. 15, 2017

(65) Prior Publication Data

US 2019/0136555 A1 May 9, 2019

Related U.S. Application Data

(63) Continuation of application No. 14/964,576, filed on Dec. 10, 2015, now abandoned.

(51) Int. Cl.

| | |
|---|---|
| ***E04H 4/06*** | (2006.01) |
| ***B63C 9/02*** | (2006.01) |
| ***B63C 9/18*** | (2006.01) |
| ***B63C 9/04*** | (2006.01) |

(52) U.S. Cl.
CPC ..... *E04H 4/065* (2013.01); *B63C 9/02* (2013.01); *B63C 9/18* (2013.01); *B63C 2009/042* (2013.01)

(58) Field of Classification Search
CPC ..... E04H 4/065; B63C 9/02; B63C 9/18
USPC ..... 4/495
See application file for complete search history.

(56) References Cited

U.S. PATENT DOCUMENTS

| | | | |
|---|---|---|---|
| 2,928,103 A | 3/1960 | Turner | |
| 2,970,320 A | 2/1961 | Karp | |
| 3,041,631 A | 7/1962 | Fogle | |
| 3,813,704 A | 6/1974 | Trolano | |

(Continued)

FOREIGN PATENT DOCUMENTS

| | | | |
|---|---|---|---|
| AU | 2010100193 A4 * | 4/2010 | ..... E04H 4/06 |
| CN | 1675660 A | 9/2005 | |

(Continued)

OTHER PUBLICATIONS

Office Action for CN Application No. 201680080922.5 dated Oct. 24, 2019.

(Continued)

*Primary Examiner* — Christine J Skubinna
(74) *Attorney, Agent, or Firm* — Pearl Cohen Zedek Latzer Baratz LLP

(57) ABSTRACT

A lifesaving system for a swimming pool includes a plurality of lifesaving modules. Each module includes a platform and is stowable in a standby configuration under a surface of water in the pool. The module is deployable to rise to a surface of water in the pool beneath a swimmer in distress so as to support the swimmer on the platform.

21 Claims, 14 Drawing Sheets

(56) References Cited

U.S. PATENT DOCUMENTS

| | | | | |
|---|---|---|---|---|
| 4,364,131 | A * | 12/1982 | Clerk | E04H 4/065 4/495 |
| 4,831,672 | A | 5/1989 | Niimura | |
| 5,043,705 | A | 8/1991 | Rooz et al. | |
| 5,832,547 | A | 11/1998 | Burroughs | |
| 6,127,930 | A | 10/2000 | Steffanus | |
| 6,574,804 | B1 | 6/2003 | Boujon | |
| 7,583,196 | B2 | 9/2009 | Cohignac et al. | |
| 9,157,250 | B2 | 10/2015 | Alammari | |
| 2006/0214805 | A1 | 9/2006 | Boujon | |
| 2007/0256228 | A1 | 11/2007 | Nexon | |
| 2013/0174770 | A1 | 7/2013 | Mauck et al. | |
| 2014/0165281 | A1* | 6/2014 | Khorsandraftar | E04H 4/065 4/495 |
| 2015/0107014 | A1 | 4/2015 | Brock | |
| 2015/0307172 | A1 | 10/2015 | Ng | |

FOREIGN PATENT DOCUMENTS

| | | | |
|---|---|---|---|
| ES | 2433740 | A1 | 12/2013 |
| FR | 2505914 | A1 | 11/1982 |

OTHER PUBLICATIONS

Office Action for U.S. Appl. No. 14/964,576 dated Sep. 22, 2017.
Office Action for U.S. Appl. No. 14/964,576 dated Sep. 4, 2019.

* cited by examiner

LIFESAVING SYSTEM AND METHOD FOR SWIMMING POOL

The present application is a National Phase filing under 35 U.S.C. § 371 of International Patent Application No. PCT/IL2016/051317, filed Dec. 8, 2016, which is based upon and claims the benefit of the priority date of U.S. patent application Ser. No. 14/964,576, filed Dec. 10, 2015, each of which is incorporated herein by reference.

FIELD OF THE INVENTION

The present invention relates to lifesaving systems and methods. More particularly, the present invention relates to a lifesaving system and method for a swimming pool.

BACKGROUND OF THE INVENTION

Prevention of drowning is a major concern for operators or owners of a swimming pool. In many cases, budgetary or other constraints may preclude the presence of a lifeguard on duty during all times that the pool is in use. For example, a swimming pool that is on a residential property (e.g., belonging to a single resident, to a group of residents, or to a landlord), or that belongs to a private business (e.g., a motel or club), may not have a lifeguard at all or may have lifeguard who is on duty for a limited number of hours (e.g., not at night). A single lifeguard or other person who is remotely supervising the pool may be responsible for supervising several pools. A single lifeguard on duty may be distracted at times or may have to take occasional breaks, such that the lifeguard may not immediately notice a swimmer who is in distress.

A swimmer in distress may require immediate attention in order to avoid worsening of the situation.

SUMMARY OF THE INVENTION

There is thus provided, in accordance with an embodiment of the present invention, a lifesaving system for a swimming pool, the system including a plurality of lifesaving modules, each module including a platform and being stowable in a standby configuration under a surface of water in the pool, that module being deployable to rise to a surface of water in the pool beneath a swimmer in distress so as to support the swimmer on the platform.

Furthermore, in accordance with an embodiment of the present invention, the plurality of lifesaving modules are stowable on a floor of the pool.

Furthermore, in accordance with an embodiment of the present invention, a module of the plurality of lifesaving modules includes an inflatable structure, wherein deployment of the module includes inflation of the structure.

Furthermore, in accordance with an embodiment of the present invention, the inflatable structure is stowable within the platform when the module is in a standby configuration.

Furthermore, in accordance with an embodiment of the present invention, a module of the plurality of lifesaving modules includes a sensor for sensing a position of the swimmer relative to the platform.

Furthermore, in accordance with an embodiment of the present invention, a module of the plurality of lifesaving modules includes a guidance device for guiding the platform to a lateral position that is beneath the swimmer.

Furthermore, in accordance with an embodiment of the present invention, the guidance device includes a steering device or a propulsion device.

Furthermore, in accordance with an embodiment of the present invention, a module of the plurality of lifesaving modules includes an inflatable structure that is configured to support a central portion of the platform.

Furthermore, in accordance with an embodiment of the present invention, a module of the plurality of lifesaving modules includes a stabilization device that is deployable to counteract tipping of the platform.

Furthermore, in accordance with an embodiment of the present invention, the stabilization device includes an inflatable bladder, a propulsion device, or an extendible counterweight.

Furthermore, in accordance with an embodiment of the present invention, the module includes a sensor to sense the tipping.

Furthermore, in accordance with an embodiment of the present invention, a module of the plurality of lifesaving modules includes a barrier that at least partially surrounds the platform and that is deployable by inflation of an inflatable structure of the module.

Furthermore, in accordance with an embodiment of the present invention, the platform includes a plurality of selectively connectable sub-modules.

Furthermore, in accordance with an embodiment of the present invention, the system includes one or a plurality of sensors to monitor activity in the pool.

Furthermore, in accordance with an embodiment of the present invention, the system includes a controller configured to deploy a module of the plurality of modules in accordance with the monitored activity.

There is further provided, in accordance with an embodiment of the present invention, a lifesaving method including: operating a plurality of sensors to monitor activity in a swimming pool; when the monitored activity is indicative of a swimmer in distress, selecting for deployment a lifesaving module of a plurality of lifesaving modules that are stowed under water in a pool; and deploying the selected module to cause the selected module to rise to a surface of the water at a sensed position of the swimmer so as to support the swimmer on a platform of the module.

Furthermore, in accordance with an embodiment of the present invention, selecting the module includes selecting a module of the plurality of lifesaving modules that is nearest to the swimmer.

Furthermore, in accordance with an embodiment of the present invention, deploying the selected module includes laterally guiding the module as it rises.

Furthermore, in accordance with an embodiment of the present invention, deploying the selected module includes triggering inflation of an inflatable structure of the module.

Furthermore, in accordance with an embodiment of the present invention, selecting for deployment includes selecting a plurality of sub-modules.

BRIEF DESCRIPTION OF THE DRAWINGS

In order for the present invention, to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1:
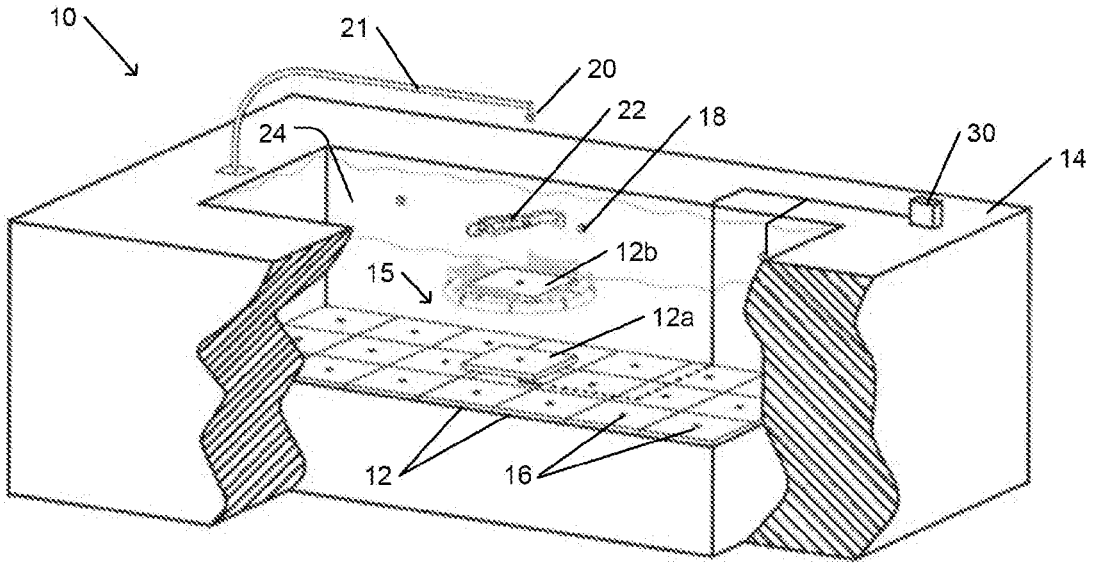
FIG. 1 schematically illustrates a swimming pool lifesaving system, in accordance with an embodiment of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, use of the conjunction "or" as used herein is to be understood as inclusive (any or all of the stated options).

Some embodiments of the invention may include an article such as a computer or processor readable medium, or a computer or processor non-transitory storage medium, such as for example a memory, a disk drive, or a USB flash memory, encoding, including or storing instructions, e.g., computer-executable instructions, which when executed by a processor or controller, carry out methods disclosed herein.

In accordance with an embodiment of the present invention, a lifesaving system includes a plurality of lifesaving modules that are arranged in a standby configuration on a floor of a swimming pool. The lifesaving modules may completely or partially cover the swimming pool floor. For example, a lifesaving module, when in the standby configuration, may form a flat, compact slab. The lifesaving modules may be arranged in a pattern on the floor of the swimming pool so as to have the appearance of swimming pool flooring. For example, lifesaving modules in the form of rectangular slabs may be arranged in a tight rectangular array to form a continuous covering over at least part of the swimming pool floor. The lifesaving modules may be colored or marked so as to match the color of walls and any visible parts of the floor of the swimming pool.

The lifesaving system is configured to monitor activity in the swimming pool and to detect activity that is indicative of a swimmer in distress or drowning. (As used herein, "swimmer" refers to a person or animal, or, during testing or development, an appropriately programmed robot, manikin, or simulator, who is present in the swimming pool, whether or not the person or animal is swimming, is attempting to swim, or has or had intention to swim.) For example, the lifesaving system may include an arrangement of cameras (e.g., operating in the visible or those infrared spectral regions in which absorption by water is minimal) or other detectors (e.g., based on acoustic or electromagnetic detection) that monitor the movement of objects, including swimmers, that are in the pool. A processor of the system is configured to analyze the acquired data to track the motion or activity of each object. In particular, the processor is configured to identify a pattern of activity that is indicative of a swimmer who is drowning, or that is otherwise in distress so as to be in danger of drowning.

The lifesaving system is configured to deploy one of the lifesaving modules when activity that is indicative of distress is identified. For example, the system may identify one of the lifesaving modules that is closest to the swimmer in distress. The identified module may be deployed to support the swimmer in distress above the water. For example, a controller of the system may communicate with each lifesaving module via one or more communications channels. The controller may send a signal or command via a communications channel to activate one of the lifesaving modules. For example, the communications channel may include a wired or wireless electronic or optical communications channel, an acoustic channel, a mechanical, hydraulic, or pneumatic channel, or any other type of channel that is suitable for communicating a signal. The signal may also indicate a detected location of the swimmer in distress.

Alternatively or in addition, the floor of the pool may be covered by an array of sub-modules. When a module is to be deployed, several sub-modules that are below the swimmer in distress may be assembled (e.g., by linking to one another while detaching from surrounding modules) into a single module. The inflatable structures of the component sub-modules may be inflated to cause the assembled module to rise below the swimmer.

For example, when a lifesaving module is deployed, an internal supply of compressed gas may be activated to inflate one or more inflatable structures of the lifesaving module. The inflation itself may provide sufficient buoyancy so as to separate the lifesaving module from neighboring modules. In other cases, prior to the inflatable structures being inflated, the lifesaving module may be initially propelled to a position that is above an array of lifesaving modules. This may reduce or eliminate any possibility that neighboring lifesaving modules could interfere with inflation of the inflatable structures. For example, the initial propulsion may be provided by a mechanical actuator, by release of compressed gas, or by separation of a deployable section of the lifesaving module from a ballast section (e.g., a weighted plate that forms a bottom layer of the lifesaving module when in a standby configuration).

Inflation of the inflatable structure may cause the lifesaving module to rise to the surface of the pool. The lifesaving module may, in some cases, be provided with at least a limited navigational capability to guide the lifesaving module to rise beneath the swimmer in distress. This navigational capability may include both detection capability to determine a current position of the submerged module relative to the swimmer (e.g., lateral position and relative depth), as well as a capability of lateral motion to move the rising module to the swimmer.

For example, the lifesaving module may be provided with a detection system that includes one or more cameras or other detectors and processing capability. The processing capability may be provided by a processor that is incorporated into the lifesaving module. Alternatively or in addition, all or some of the processing capability may be provided by a processor (e.g., of the lifesaving system) that is in communication with the lifesaving module.

As the lifesaving module rises to the surface, the detection system may detect and identify a location of the swimmer in distress relative to the lifesaving module. The lifesaving module may also be provided with one or more actuated guidance structures (e.g., flaps that function as rudders or guidance planes) to control lateral motion of the lifesaving module as it rising to its buoyancy. Alternatively or in addition, the lifesaving module may be provided with a mechanism (e.g., motorized propellers, paddles, or fins, controllable jets of water or another fluid, or another propulsion mechanism) for laterally propelling the lifesaving module prior to reaching the water surface. The guidance structure or propulsion mechanism may be operated to laterally move the lifesaving module to a position that is beneath the swimmer in distress. Thus, when the lifesaving module rises to the surface of the swimming pool, a platform of the lifesaving module may be positioned directly beneath (e.g., approximately centered below) the swimmer in distress. The rising to the water surface may thus lift the swimmer on the platform so that the swimmer is supported at least partially above the surface of the water. The module may be configured such that the lifesaving module is balanced when supporting the swimmer (e.g., to prevent or reduce the possibility of tipping).

The inflatable structure may include an inflatable ring (e.g., in the form of a circular or oval toroid, rectangular or polygonal, or in another shape) that forms an outer perimeter of a deployed lifesaving module. The ring may symmetrically laterally surround the distributed designed such that the platform for supporting the swimmer is approximately level. For example, the module may be configured such that the center of buoyancy of the module is higher than its center of gravity.

The inflatable structure may be mechanically connected to other structures of the module. Thus, inflation of the inflatable structure may deploy other structures of the lifesaving module. For example, the inflatable structure in the form of an inflatable ring may be tethered or yoked to netting that is pulled outward to form a cradle on top of the lifesaving module. The cradle may impede or prevent the lifted swimmer from sliding or otherwise falling off the top of the lifesaving module and back into the water. Alternatively or in addition, another mechanism may be provided for deploying structures of the lifesaving module.

A lifesaving module may be provided with additional structure or mechanisms to enable stable support of the swimmer above the water. For example, the lifesaving module may be provided with one or more sensors that enable detection of an imbalance that may cause the lifesaving module to tip over. Such an imbalance may be caused, for example, by imperfect centering of the lifted swimmer above an epicenter of the lifesaving module. An imbalance may be created by motion of the lifted swimmer, or by contact with another object (e.g., another swimmer). For example, the sensors may include one or more tilt sensors or accelerometers. The lifesaving module may be provided with a stabilization mechanism for counteracting any tilting force. For example, the stabilization mechanism may include one or more auxiliary inflatable bladders that may be inflated to counteract a tipping force. As another example, the stabilization mechanism may include a motorized or otherwise operated corrective propulsion mechanism that may be operated so as to counteract a tipping force. As another example, the stabilization mechanism may include one or more extendible structures (e.g., wings, planes, rods, or other structures) that may be extended to counteract a tipping force.

FIG. 1 schematically illustrates a swimming pool lifesaving system, in accordance with an embodiment of the present invention.

Swimming pool lifesaving system 10 includes a plurality of lifesaving modules 12. Each lifesaving module 12, until activated, may be stored in a standby configuration. When in a standby configuration, components of lifesaving module 12 are retracted or folded, as appropriate, in a compact form. For example, the compact form may be in the form of a flat rectangular slab, as shown. Alternatively or in addition, all or some of lifesaving modules 12 may have a compact form in a standby configuration that is flat but not rectangular, or may have another compact form.

Swimming pool lifesaving system 10 is configured to operate in and around swimming pool 14 that is filled with water to water surface 24. For example, when in the standby mode, each lifesaving module 12 may be configured to lie on the bottom of swimming pool 14. When arranged in a compact rectangular array, as shown, lifesaving modules 12 may line all or part of floor 15 of swimming pool 14. For example, lifesaving modules 12 may be arranged to line floor 15 only at the deep end of swimming pool 14, or another part of swimming pool 14. Different types or sizes of lifesaving modules 12 may be arranged along floor 15 at different parts of swimming pool 14. For example, a lifesaving module 12 that is configured for placement at the deep end of swimming pool 14 may differ (e.g., in size, guidance capability, or otherwise) from a lifesaving module that is configured for placement at a shallow end of swimming pool 14. In some cases, spacing structure may be placed between or surrounding lifesaving modules 12 in order to fill all of floor 15, or entire contiguous section of floor 15, of swimming pool 14.

For aesthetic reasons, or in order that swimming pool lifesaving system 10 remain unobtrusive to swimmers, some or all of lifesaving modules 12 may be colored, patterned, textured, or otherwise formed so as to have the appearance (and in some cases, the feel) of a typical swimming pool floor.

When in the standby configuration, each lifesaving module 12 may be in communication with system control 30. For example, system control 30 may be located near, or may be incorporated within, one or more other components of swimming pool lifesaving system 10 or of swimming pool 14. Alternatively or in addition, all or some components of system control 30, or may be located remotely from other components of swimming pool lifesaving system 10 or from swimming pool 14.

System control 30 is in communication with one or more sensors. For example, the sensors may include some or all of upward-looking sensors 16, lateral sensors 18, and downward-looking sensors 20. For example, an upward-looking sensor 16 may be incorporated into a lifesaving module 12 (e.g., when in a standby mode), into floor 15 of swimming pool 14 (e.g., at a position that is not covered by a lifesaving module 12, or that is below lifesaving module 12 when lifesaving module 12 is transparent to radiation or other quantity that is sensed by that upward-looking sensor 16), or otherwise (e.g., into a robotic or other device that floats, stands, or crawls on or near the bottom of swimming pool 14). A lateral sensor 18 may be incorporated into a wall of swimming pool 14 or otherwise (e.g., into a robotic or other device that floats, stands, or crawls on or near a wall of swimming pool 14, or that floats at an underwater depth between the top surface and bottom of swimming pool 14). A downward-looking sensor 20 may be located at or above water surface 24 of swimming pool 14. For example, downward-looking sensor 20 may be placed on supporting structure 21 (e.g., a boom, beam, scaffolding, or other structure), may be incorporated into a ceiling above swimming pool 14, or otherwise (e.g., into a robotic or other device that floats at water surface 24, or that hovers above water surface 24). The sensors may include video cameras or other optical detectors operating in the visible or other (e.g., near infrared) spectral ranges, acoustic detectors, mechanical detectors (e.g., to measure waves or changes in pressure), or other sensors.

The sensors may include an array of one or more beam emitters (e.g., collimated light source, laser, diode laser, light-emitting diode, or other source of a beam having a predetermined form) that are configured to emit a beam (e.g., pencil beam or fan beam) of visible or non-visible (e.g., infrared) electromagnetic radiation. A corresponding array of one or more beam sensors may detect when an object interrupts the beam between a beam emitter and a beam sensor. For example, lateral sensors 18 may include an array of beam emitters and beam sensors that form an array of substantially horizontal beams. In some cases, the horizontal beams may be arranged near the floor of the pool. The array of beams may facilitate accurate determination of a location of a distressed swimmer 22. One or more additional sensors (e.g., a similar array of sensors near the water surface, imaging sensors to which image processing is applied, an array of vertical sensors, or other techniques) may be applied to distinguish detection of a distressed swimmer 22 from detection of legs of people standing in swimming pool 14 or an inanimate object that is resting on the floor of swimming pool 14.

In some cases, illumination may be provided to facilitate or enable operation of one more of lateral sensors 18 or downward-looking sensors 20. For example, the illumination may be incorporated into the sensor, or may be separate from the sensor. For example, the illumination may serve as general lighting of swimming pool 14 or the surrounding area. The illumination may be generated by low-power sources, such as light emitting diodes (LEDs) or other low power sources. The illumination sources may be configured to emit light of different colors (e.g., different types of LEDs). In this case, the color of the emitted light may be changed in accordance with a current status, e.g., in order to signal detection of a swimmer in distress. In some cases, illumination may be invisible, e.g., in the infrared or near infrared spectral ranges, for use with an appropriate sensor. The illumination may be continuous, may be periodic, or may be activated in response to a predetermined event (e.g., when an initial sensor reading indicates the possible presence of a distressed swimmer 22 or in response to another event).

System control 30 may be configured to analyze data that is sensed by the sensors. The analysis may identify a distressed swimmer 22. Upon identification of distressed swimmer 22, system control 30 may communicate with or activate one or more lifesaving modules 12. System control 30 may control a lifesaving module 12 to begin to deploy, as illustrated by deploying module 12*a*.

Deploying module 12*a*, as shown, has risen above the other lifesaving modules 12. For example, inflation of inflatable structure of lifesaving module 12 may cause a lifesaving module 12 to rise to the position of deploying module 12*a*. Alternatively or in addition, a deploying module 12*a* may be propelled upward to the position of deploying module 12*a*. For example, deploying module 12*a* may be propelled upward by a mechanical actuator, by a jet of water or release of compressed gas, or by separation from a ballast section that provides sufficient weigh to enable lifesaving module 12 to rest on the bottom of swimming pool 14.

Finally, deploying module 12*a* may be deployed to become deployed module 12*b*. In deployed module 12*b*, inflatable structures have been inflated to cause deployed module 12*b* to rise to water surface 24. As deployed module 12*b* rises to water surface 24, deployed module 12*b* may be laterally guided or propelled so as to rise under distressed swimmer 22. Thus, when deployed module 12*b* reaches water surface 24, deployed module 12*b* may lift part or all of distressed swimmer 22 above water surface 24.

Figure 2:
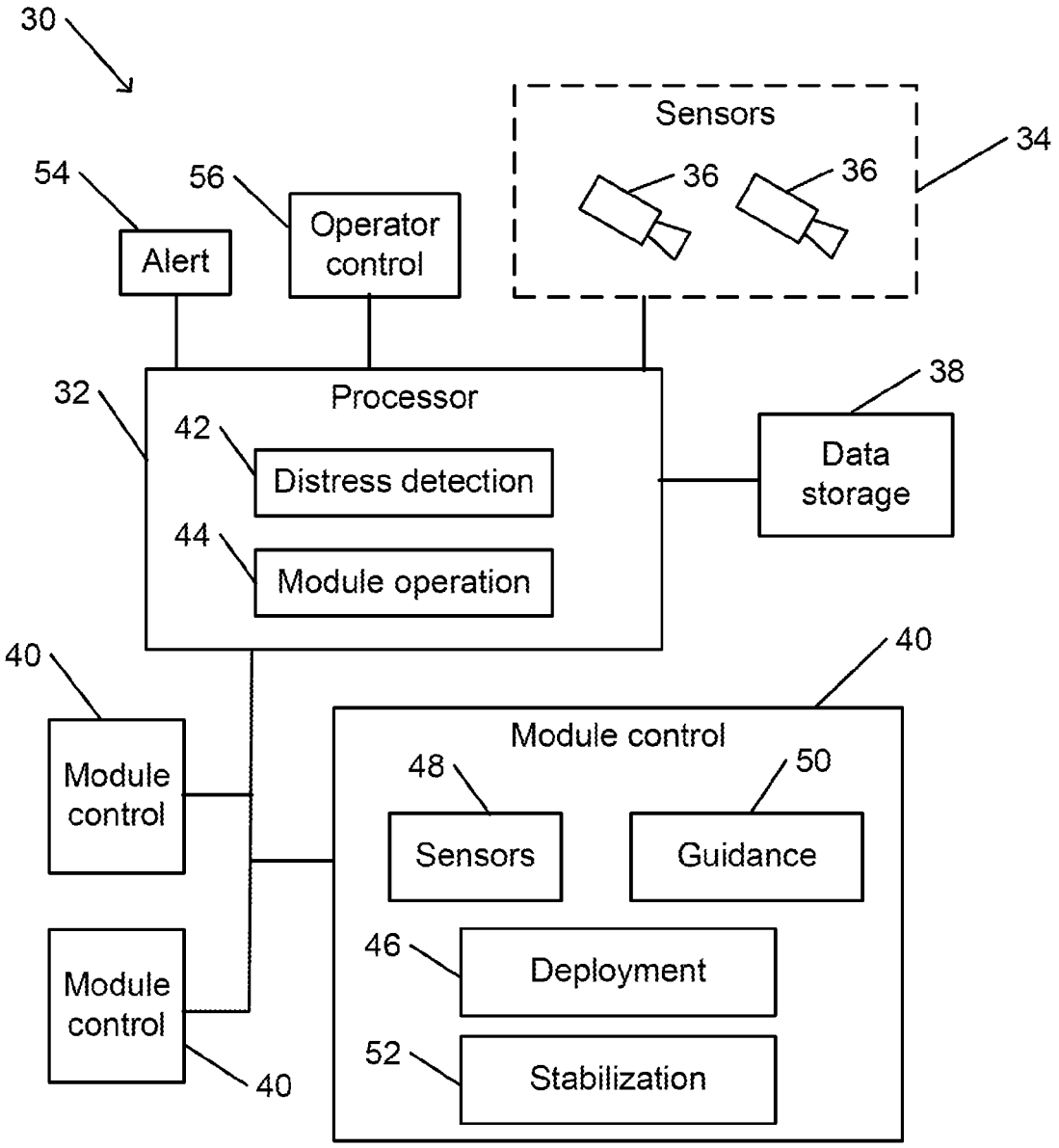
FIG. 2 schematically illustrates a controller for the swimming pool lifesaving system shown in FIG. 1.

FIG. 2 schematically illustrates system control for the swimming pool lifesaving system shown in FIG. 1.

System control 30 includes a processor 32. For example, processor 32 may include one or more processing units. For example, processing units of processor 32 may be housed in a single housing, or may be incorporated into one or more components of swimming pool lifesaving system 10. For example, one or more processing units of processor 32 may be incorporated into one or more of sensors 34 (e.g., into one or more of upward-looking sensors 16, lateral sensors 18, and downward-looking sensors 20), into one or more of lifesaving modules 12, or elsewhere. One or more processing units of processor 32 may be located at a remote location, such as at a server of a service that operates, maintains, supervises, or monitors swimming pool lifesaving system 10.

Processor 32 may communicate with data storage device 38. Data storage device 38 as referred to herein may include functionality of a computer memory, a computer readable storage medium, long-term storage medium, or both. Data storage device 38 may include one or more volatile or nonvolatile, fixed or removable, data storage devices. Data storage device 38 may be utilized to store, for example, programmed instructions for operation of processor 32, data or parameters for use by processor 32 during operation, or results of operation of processor 32.

Processor 32 may be configured to operate in accordance with programmed instructions that are stored on data storage device 38.

Processor 32 may receive signals from sensors 34. For example, sensors 34 may include upward-looking sensors 16, lateral sensors 18, and downward-looking sensors 20. In particular, some or all of sensors 34 may include one or more imaging devices 36. For example, an imaging device 36 may include a video or still camera that is capable of acquiring images (e.g., video frames or a sequence of single images) in the visible, near infrared, or far infrared spectral ranges. In particular, imaging device 36 may be configured to acquire images in spectral regions in which absorption by water is relatively low. In alternatively or in addition, sensors 34 may include various distance sensors (e.g., based on acoustical, optical, electromagnetic, or other techniques).

Programmed instructions for operation of processor 32 may include distress detection module 42. Execution of distress detection module 42 may include processing signals from sensors 34 to identify signals, or combinations of signals, that are indicative of a swimmer in distress. For example, acquired images may be subjected to image analysis to identify a pattern of movement of the swimmer and the swimmer's limbs that is indicative of distress.

The fields of view of pairs of neighboring imaging devices 36, such as of neighboring upward-looking sensors 16, lateral sensors 18, or downward-looking sensors 20, may be configured to at least partially overlap. Where the fields of view overlap, triangulation or multiple view/stereo imaging techniques may be applied to yield a three-dimensional mapping of objects within the pool. In order to maximize coverage of the pool volume with a limited number of imaging devices 36, each imaging device 36 may be provided with a wide-angle lens or other wide angle optics. In some cases, the field of view of an imaging device 36 provided with wide-angle optics may approach or be equal to 180°.

Processor 32 may communicate with one or a plurality of lifesaving module controllers 40. For example, the communication may include a wired or wireless electronic (e.g., WiFi, e.g., where each lifesaving module controller 40 is connected to an antenna that extends above the water surface) or optical communications channel, an acoustic channel (e.g., transmitted via the water in the swimming pool), a mechanical, hydraulic, or pneumatic channel, or any other type of channel that is suitable for communicating a signal.

For example, when a swimmer in distress is identified during execution of distress detection module 42, processor 32 may execute lifesaving module operation module 44 to operate one or more lifesaving modules 12. Execution of lifesaving module operation module 44 may include communicating with a selected lifesaving module controller 40. For example, communication with the selected lifesaving module controller 40 may include transmitting to lifesaving module controller 40 a location of the identified swimmer in distress, e.g., relative to the selected lifesaving module 12.

Each lifesaving module controller 40 may include a processor. The processor may include a processing unit of processor 32, or may include one or more separate processing units.

Lifesaving module controller 40 may include deployment unit 46. Lifesaving module controller 40 may operate in response to an instruction to deploy a selected lifesaving module 12 during execution of lifesaving module operation module 44. For example, deployment unit 46 may be configured to inflate one or more inflatable structures of the selected lifesaving module 12. Deployment unit 46 may be configured to deploy one or more additional components of lifesaving module 12, such as a meshwork or webbed cradle or other component.

Lifesaving module controller 40 may communicate with module sensors 48. Module sensors 48 may include some or part of sensors 34, or may be separate from sensors 34. For example, module sensors 48 may include an upward looking sensor or camera (e.g., upward-looking sensor 16, or another sensor) that is mounted on an upper surface of lifesaving module 12. Module sensors 48 may be configured to detect a position of a swimmer in distress relative to the selected lifesaving module 12. Module sensors 48 may include, for example, an imaging device that acquires images of objects, such as a swimmer in distress. Module sensors 48 may include one or more other sensors that enable determination of a position of lifesaving module 12. For example, module sensors 48 may include one or more navigation sensors to determine a position or orientation of lifesaving module 12 (e.g., compass, tilt sensor, depth sensor, rangefinder, or other navigation sensor). Module sensors 48 may include one or more sensors to determine a weight or distribution of weight of a load that is supported on lifesaving module 12.

Lifesaving module controller 40 may include guidance unit 50. Guidance unit 50 may operate in coordination with module sensors 48 to guide or propel lifesaving module 12 to an identified object such as a swimmer in distress. For example, guidance unit 40 may include one or more guidance devices (e.g., flaps that function as rudders, planes, or wings, or other devices for guiding a direction of motion of a rising lifesaving module 12) or propulsion devices (e.g., a motorized or otherwise powered propeller, fin, paddle, jet, or other propulsion device). Guidance unit 50 may be operated to maneuver lifesaving module 12 to a position beneath the swimmer in distress. For example, guidance unit 40 may be operated such that when lifesaving module 12 rises to the water surface, lifesaving module 12 is laterally centered beneath the swimmer in distress.

Lifesaving module controller 40 may include stabilization unit 52. Stabilization unit 52 may operate in coordination with module sensors 48 to prevent tipping or overturning of lifesaving module 12 after lifesaving module 12 has surfaced while supporting a load, such as a swimmer in distress. Stabilization unit 52 may be configured to activate, operate, or deploy one or more stabilization devices to counteract a detected (e.g., by a tilt sensor or accelerometer) tipping of lifesaving module 12. For example, stabilization unit 52 may include a plurality of inflatable bladders or water wings that are distributed near the perimeter of lifesaving module 12. One or more of the bladders may be selectively inflated. For example, when module sensors 48 detect that one side of lifesaving module 12 is being tipped downward (e.g., due to imperfect centering of the load on lifesaving module 12, or due to a subsequent shift in position of the load), one or more of the bladders on that side may be inflated. The subsequent increased buoyancy on that side may tend to lift that side to counteract the tipping. As another example, stabilization unit 52 may include a plurality of nozzles, propellers, or other devices that may be selectively operated to generate a downwardly-directed jet, stream, or flow of fluid to counteract a detected tilting. As another example, stabilization unit 52 may include one or more extendible wings, bars, weights, or other structures that may be selectively extended to counteract a detected tilting (e.g., by generating a counter-torque to counteract the tipping, or by providing increased buoyancy or fluid resistance to counteract or impede the tipping).

System control 30 may include an alert unit 54. For example, processor 32 may operate alert unit 54 under one or more predetermined conditions. Such conditions may include, for example, detection of a swimmer in distress, deployment of a lifesaving module 12, surfacing of a lifesaving module 12, or another condition. Operation of alert unit 54 may include generation of an audible (e.g., audible message or sound) or visible (e.g., text or graphic message, or warning light) alarm signal, recording of an event in a log (e.g., on data storage device 38 or elsewhere), or generation of notification that is transmitted to a remote device (e.g., of a remote server of a service that operates or monitors operation of swimming pool lifesaving system 10). An alarm signal may be transmitted to a device at a lifeguard station, at a control station, to a mobile device (e.g., mobile telephone, computer, or pager) of a person who is responsible for operation of the pool, to an alarm device near the pool, or to another device.

Processor 32 may communicate with operator control 56. For example, operator control 56 may include one or more devices that may be operated by a human operator to control, override, or modify operation of system control 30. An operator of operator control 56 may monitor operation of system control 30 and of swimming pool lifesaving system 10. The monitoring may include observation of a display screen or control panel that may indicate a state of operation of one or more components of system control 30 or of swimming pool lifesaving system 10. Alternatively or in addition, the operator (e.g., a lifeguard or member of a swimming pool management staff) may directly observe activity in swimming pool 14. The monitoring may be continuous or may be in response to an alert that is generated by alert unit 54.

Operator control 56 may be operated to cancel or modify an operation that is being executed by system control 30. For example, an operator that is observing (e.g., directly, or remotely via a camera and remote monitor) swimming pool 14 may determine that an object that was identified by system control 30 to be a swimmer in distress is, in fact, not in distress, or that the swimmer may be assisted without deployment of a lifesaving module 12. Operator control 56 may be operated to assist in operation of guidance unit 50, e.g., when automatic guidance has been disrupted (e.g., by the presence of other swimmers). Operator control 56 may be operated to deploy a lifesaving module 12, e.g., for testing purposes or upon observing a swimmer in distress when execution of distress detection module 42 has failed to detect the swimmer in distress.

Figure 3:
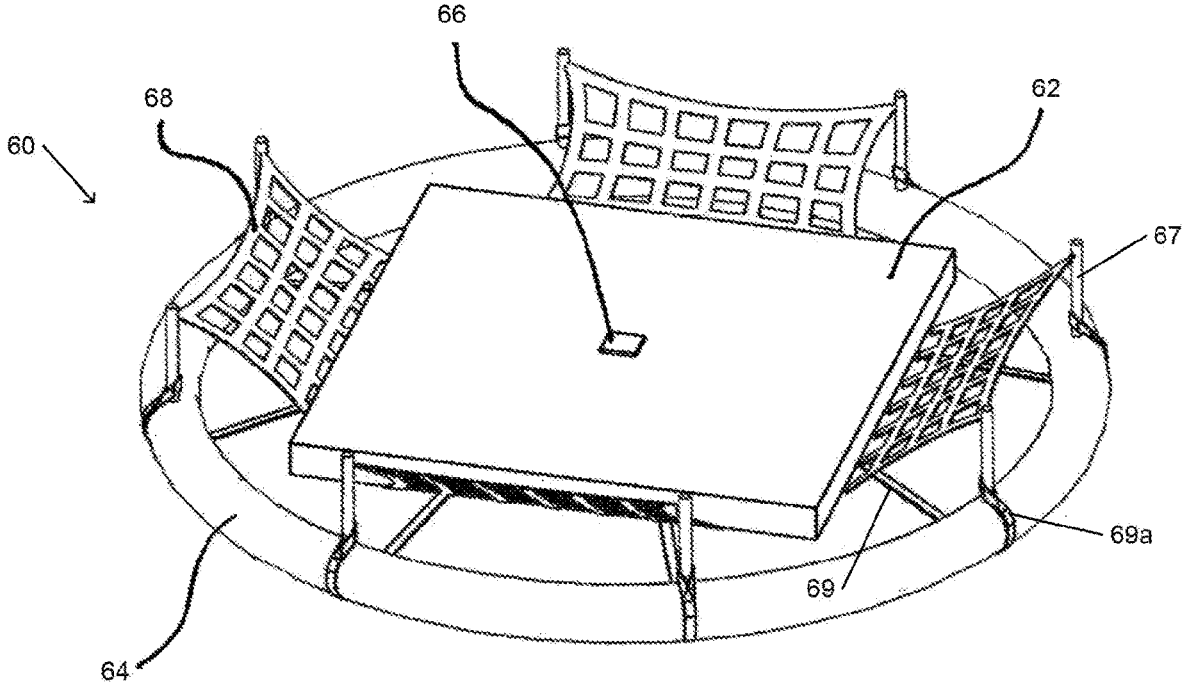
FIG. 3 schematically illustrates a deployed lifesaving module of the swimming pool lifesaving system shown in FIG. 1.

FIG. 3 schematically illustrates a deployed lifesaving module of the swimming pool lifesaving system shown in FIG. 1.

Typically, a lifesaving module 12 (FIG. 1) may be deployed to form deployed lifesaving module 60 when lifesaving module 12 is beneath the surface of the water. Deployment may include inflation of one or more inflatable flotation structures (e.g., to inflated ring 64, or to form one or more other inflated floats, pontoons, bladders, balloons, or other inflatable structure). For example, deployment may include triggering a chemical process to rapidly generate an inflating gas. Deployment may include opening a valve or seal to release an inflating gas (e.g., air, carbon dioxide, nitrogen, helium, or another compressible gas) from one or more canisters of compressed gas that are stowed on or within lifesaving module 12. Alternatively or in addition, inflatable structure of lifesaving module 12 may be initially connected via a tube to a source of compressed gas (e.g., a tank, canister, or pump). For example, the source may be common to all or some lifesaving modules 12 of a swimming pool lifesaving system 10. In this case, deployment may include opening a valve or operating a pump to inflate the inflatable structure via the tube.

Deployed lifesaving module 60 includes platform 62. Platform 62 is configured to support a load of one or more objects, such as a swimmer in distress. Platform 62 may have a size and shape that is suitable for supporting the object. For example, platform 62 may be shaped such that an expected load (e.g., a swimmer in distress) may be supported by platform 62. In some cases, platform 62 may have dimensions that are at least size of or larger than the maximum expected dimensions of the load (e.g., of a swimmer in distress in a prone or supine position).

Platform 62 may be configured to support the weight of an expected load while enabling the buoyancy of inflatable structure of deployed lifesaving module 60 to support platform 62 and its load above the water surface. For example, platform 62 may be made of a suitable plastic that is sufficiently strong so as to support the object when at least partially lifted above the water surface without significant sagging or bending (which could form a concave depression on the top of platform 62 in which significant quantities of water may accumulate). On the other hand, platform 62 may be sufficiently light such that inflated structure of deployed lifesaving module 60, such as inflated ring 64, may at least partially raise platform 62 and a supported load (e.g., a swimmer in distress) above the water surface.

For example, platform 62 may be hollow. In some cases, platform 62 may include internal structure (e.g., internal braces, walls, or ridges) that is configured to increase the mechanical strength of platform 62 without excessively increasing its weight. In some cases, platform 62 may include a solid slab of a material. For example, platform 62 may be constructed of a solid foam material with a density near to, or less than, that of water. Thus, the buoyancy of platform 62 may assist in raising deployed lifesaving module 60 to the water surface. (In this case, storage of lifesaving module 12 at or near the bottom of a swimming pool may require connection of lifesaving module 12 to a weighted ballast structure, or tethering lifesaving module 12 to structure that is fixed to the bottom of the swimming pool.)

In some cases, platform 62 may be designed so as to be sufficiently rigid so as to support a load without sagging or formation of depressions only when platform 62 and its load (e.g., a swimmer in distress) are partially supported by buoyant forces, e.g., prior to lifting the load above the water surface. Additional support structure (such as an approximately centered inflatable structure) may be provided to additionally support the central portion of platform 62 at a stage when platform 62 and its load are lifted above the water surface (e.g., as shown in FIG. 5B). The additional support structure (such as central inflatable structure 82 (shown in FIG. 5), or other additional support structure) may be configured for automatic deployment (e.g., inflation) when platform 62 reaches the water surface e.g., as determined by an appropriate sensor (such as an optical sensor, an electromagnetic sensor, a pressure sensor, a stress sensor, or other suitable sensor). Use of such additional central support may obviate any need for reinforcement in the form of ribs or other rigid structure that could increase the weight of platform 62.

During storage on a swimming pool floor of lifesaving module 12 prior to deployment, additional rigidity of platform 62 (e.g., to prevent buckling or bending when supporting a weight, e.g., during maintenance or cleaning of the pool when the pool is empty) may be provided by columns or similar structure on the floor of the swimming pool beneath lifesaving module 12.

Figure 4A:
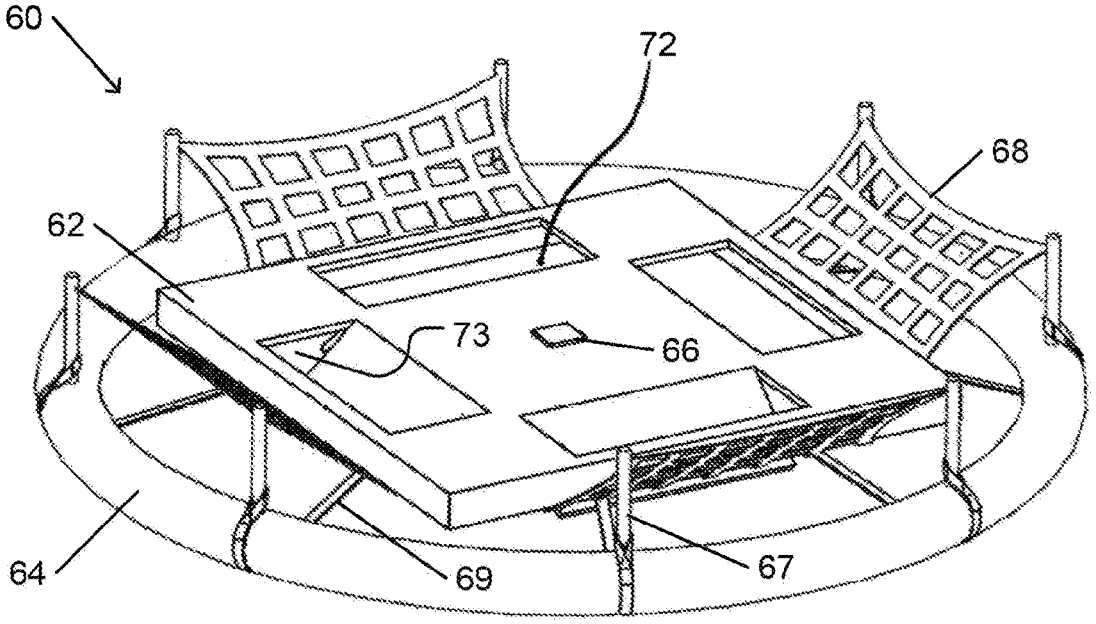
FIG. 4A schematically illustrates components of the lifesaving module shown in FIG. 3.
Figure 4B:
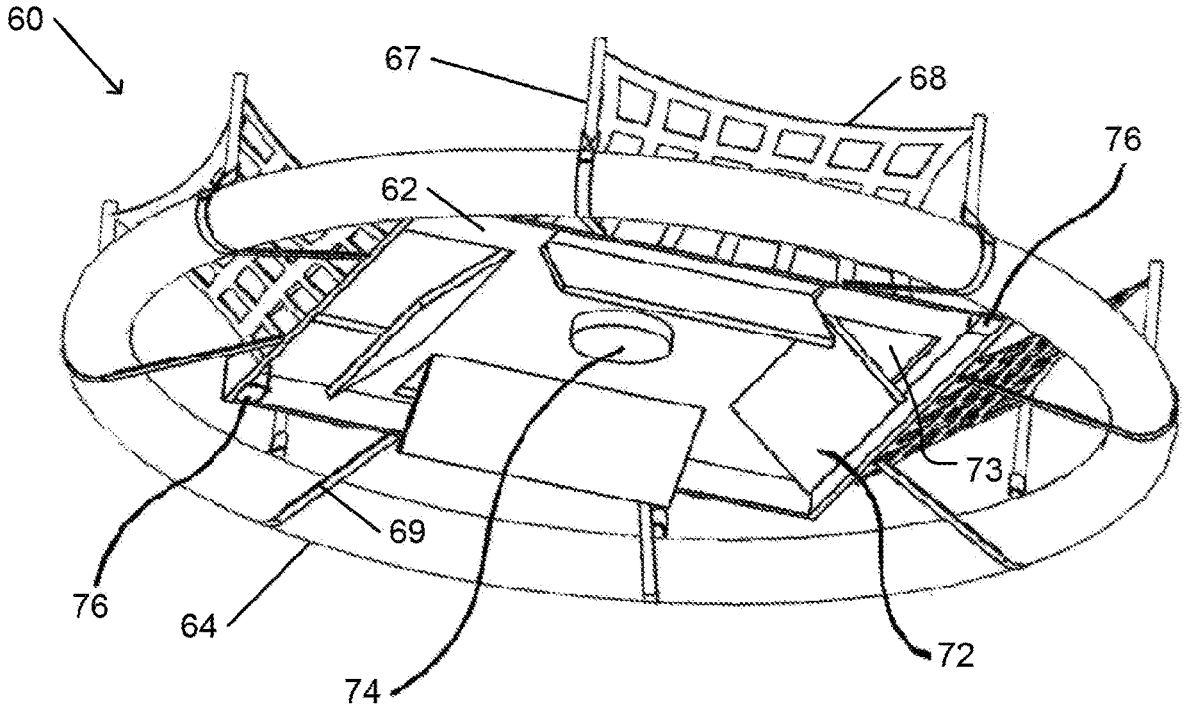
FIG. 4B shows the bottom of the lifesaving module shown in FIG. 4A.

Platform 62 may be in the form of a hollow flat box with one open face (e.g., a downward-facing face, as shown in FIG. 4B). Structure of a lifesaving module 12 that is deployable to form deployed lifesaving module 60 may be stowed prior to deployment, e.g., in a collapsed or folded configuration, inside the hollow interior of platform 62. Where lifesaving modules 12 are to be stowed prior to deployment in a closely packed array, platform 62 may be shaped to form such an array. Thus, platform 62 may be rectangular as shown, or may have square or hexagonal shape. Where close packing is not required, platform 62 may be otherwise shaped. Alternatively or in addition, prior to deployment, structure of deployed lifesaving module 60 may be stowed on, under, or around platform 62.

An upper surface of platform 62 may be configured to prevent or impede a supported load from sliding off of platform 62. For example, an upper surface of platform 62 may be covered with a rubberlike or other type of material with a high coefficient of friction. An upper surface of platform 62 may be textured or otherwise configured to inhibit or prevent sliding of load that is supported on platform 62. A top surface of platform 62 may be concave. Deployed lifesaving module 60 may include one or more barriers, such as webs 68, a rim, vertical posts or columns, or another barrier, that at least partially surround platform 62. The barriers may prevent or impede a load that is supported by platform 62 from sliding off of platform 62. The barriers may include openings that enable water to drain off the top of platform 62.

Module sensor 66 may be mounted on platform 62 or elsewhere on deployed lifesaving module 60. Module sensor 66 may include a single unit that includes one or more sensors, or may be understood to represent a plurality of sensors that are distributed among various locations on deployed lifesaving module 60.

Module sensor 66 may represent one or more imaging sensors, range sensors, proximity sensors, navigational sensors (e.g., position sensors, orientation sensors, accelerometers, tilt sensors) or other sensors that are configured to determine a current position of an object relative to deployed lifesaving module 60. For example, prior to deployment, module sensor 66 may function as upward-looking sensor 16. As another example, module sensor 66 may be separate from upward-looking sensors 16.

Module sensor 66 may be configured to sense a position of a swimmer of distress who is above deployed lifesaving module 60 when deployed lifesaving module 60 is still submerged. Sensing of the position of the swimmer in distress by module sensor 66 may assist in guiding deployed lifesaving module 60 to the swimmer as deployed lifesaving module 60 rises toward the water surface. Alternatively or in addition, deployed lifesaving module 60 may be in communication with one or more external sensors (e.g., upward-looking sensors 16, lateral sensors 18, or downward-looking sensors 20) to assist in guiding deployed lifesaving module 60 to the swimmer in distress.

Module sensor 66 may include additional sensors that may enable or facilitate assistance to a swimmer in distress. For example, module sensor 66 may include one or more biometric sensors that may provide at least a gross indication of a state of health of a swimmer in distress (e.g., detection of heartbeat, breathing, or body temperature). A strain gauge or scale may enable determination of water content of the swimmer (e.g., whether or not the swimmer's lungs have filled with water). Module sensor 66 may include one or more sensors that may assist in preventing a supported load from slipping off of platform 62. For example, module sensor 66 may include one or more tilt sensors, or one or more weight sensors to enable determination of a distribution of a load on platform 62.

Inflated ring 64 may have a shape that is suitable for supporting platform 62 in a stable manner. Inflated ring 64 may be laterally larger (e.g., greater length and width) than platform 62. For example, when platform 62 is rectangular, as shown, inflated ring 64 may have an oval or elliptical shape that approximately circumscribes platform 62. Inflated ring 64 may be securely tethered or otherwise connected to platform 62 via connection structure 69. For example, connection structure 69 may include a cord, cable, band, strip, or other flexible connecting structure that may be pulled taut during inflation of inflated ring 64.

A mechanism may be provided for deploying webs 68 to surround platform 62. When deployed, webs 68 may form a cradle for preventing or impeding a supported load from sliding off of platform 62. For example, a mechanism that inflates inflated ring 64 may be configured to extend webs 68 outward from platform 62. Structure, such as one or more web support rods 67, that moves outward during inflation of inflated ring 64 may be configured to pull outward or otherwise extend one or more webs 68. The structure may also be configured to support and apply tension to a distal end of each web 68 after deployment. For example, web support rods 67 may extend from the surface of inflated ring 64, or may be otherwise connected to inflated ring 64. Web support rods 67 may be constructed of a rigid material, such as steel or another rigid metal, a rigid plastic, wood, or another rigid material. Web support rods 67 may also apply a diagonally upward and outward force on platform 62 via the tension that is applied to webs 68. The applied tension may apply a force with a sufficient upward component so as to hold platform 62 above the water surface.

A distal end 69*a* of each connection structure 69 (e.g., in the form of a strap) may be attached to a web support rod 67. The connection of distal end 69*a* to web support rod 67 may apply a counterforce to support rod 67 to prevent the tension in web 68 from pulling the attached web support rods 67 inward, thus assisting in maintaining web 68 in an extended configuration.

Alternatively or in addition, another method may be provided for deploying web 68 or similar structure.

Deployed lifesaving module 60, after inflation of inflatable structure, e.g., to form inflated ring 64, or after otherwise becoming buoyant (e.g., by separation from ballast), may rise toward the surface of the water. Deployed lifesaving module 60 may include structure that enables guiding platform 62 of deployed lifesaving module 60 to an object that is to be loaded onto, and supported by, platform 62.

FIG. 4A schematically illustrates components of the lifesaving module shown in FIG. 3. FIG. 4B shows the bottom of the lifesaving module shown in FIG. 4A.

Operation of one or more components of deployed lifesaving module 60 may be controlled by module controller 74. Module controller 74 may include processing capability to analyze one or more sensor readings or communicated signals and operate one or more devices of deployed lifesaving module 60. Alternatively or in addition, module controller 74 may be configured (e.g., with appropriate circuitry) to operate one or more devices of deployed lifesaving module 60 in response to a signal that is received from a remote controller or processor.

Module controller 74 may operate one or more devices to deploy deployed lifesaving module 60. For example, module controller 74 may open a valve or otherwise open a canister of compressed gas to inflate an inflatable structure of deployed lifesaving module 60. Module controller 74 may operate an actuator to release deployed lifesaving module 60 from a weight or ballast.

Module controller 74 may communicate with module sensor 66 to identify a position of an object that is to be lifted from the water, such as a swimmer in distress, relative to deployed lifesaving module 60. Module controller 74 may then operate one or more guidance or propulsion devices to guide deployed lifesaving module 60 to the object. Module controller 74 may communicate with module sensor 66 to identify a tilt of platform 62, or an uneven distribution of a load on platform 62. Module controller 74 may then operate one or more stabilization devices to prevent the load from falling or slipping off of platform 62.

A guidance device of deployed lifesaving module 60 may include a steering device or a propulsion device.

For example, guidance flaps 72 may represent a steering device. When operating as a steering device, each guidance flap 72 may be tilted to act as a rudder. Thus, guidance flap 72 may laterally steer deployed lifesaving module 60 as buoyant forces drive deployed lifesaving module 60 upward to the water surface. For example, lowering a guidance flap 72 may open module opening 73 such that water may pass through module opening 73 as deployed lifesaving module 60 rises. In some cases, one or more of guidance flaps 72 may be shaped or profiled with an appropriate hydrodynamic shape so as to facilitate guidance of deployed lifesaving module 60 by of guidance flap 72. A guidance flap 72 may represent a set of fins (e.g., formed similar to a louvered vent) that are tiltable in parallel or in tandem to guide motion of deployed lifesaving module 60, or another arrangement of fins, flaps, or other guiding structure.

Each guidance flap 72 may be provided with one or more actuators to change a tilt of guidance flap 72. Operation of the actuators may be controlled by module controller 74. Alternatively or in addition, a guidance flap may simply be enabled to open (e.g., may be unlatched) and to drop to the full extent that is enabled by a stop or other structure.

In some cases, once deployed lifesaving module 60 has risen to the water surface, one or more guidance flaps 72 may be raised to close module opening 73. In some cases, e.g., when part of the supported load (e.g., a limb of a swimmer in distress) interferes with the raising of guidance flap 72, module opening 73 may remain open. For example, an actuator to raise guidance flap 72 may be provided with a clutch or sensor that aborts the raising of guidance flap 72 when the raising is interfered with.

Alternatively or in addition, a guidance device of deployed lifesaving module 60 may include one or more propulsion devices. For example, when operated as a propulsion device, guidance flaps 72 may be moved in the manner of fins (e.g., guidance flaps being flexible and hydrodynamically shaped to provide propulsion through water). As another example, module controller 74 may be configured to operate one or more pumps, propellers, paddles, fins, or other devices to produce a jet or stream of water or another fluid (liquid or gas) to laterally propel deployed lifesaving module 60 to a position beneath an object that is to be lifted.

Module controller 74 may operate one or more stabilization devices 76. For example, module sensor 66 may sense a situation in which platform 62 is tipping or in which a load is not being supported by platform 62 in a stable manner. In that case, a stabilization device 76 may be activated to counteract the tipping or to more stably support the load.

For example, each stabilization device 76 may include an inflatable bladder in the form of an inflatable ball, ring, mat, or other inflatable form. Activating stabilization device 76 may then include inflating the bladder to provide additional buoyancy to a corner or end of platform 62 that is being tipped downward. For example, a bladder may be inflated using a rapid gas generation or release process. As another example, a bladder may be inflated by a system in which air is pumped into the bladder (e.g., via a snorkel with an opening that is maintained at a position above the water surface.

Stabilization device 76 may include a propulsion device such as a pump, fan, propeller, fin, paddle, fluid jet (e.g., connected to a source or pressurized water or another fluid), canister of compressed gas (operable by opening or closing a valve), or another propulsion device. Activating stabilization device 76 may include operating the propulsion device to produce a downward jet or stream of fluid (liquid or gas) to propel upward a corner or end of platform 62 that is being tipped downward.

Stabilization device 76 may include an extendible counterweight. Activating stabilization device 76 may include extending the counterweight outward to apply a downward torque to a corner or end of platform 62 that is opposite a corner or end that is being tipped downward.

Figure 5A:
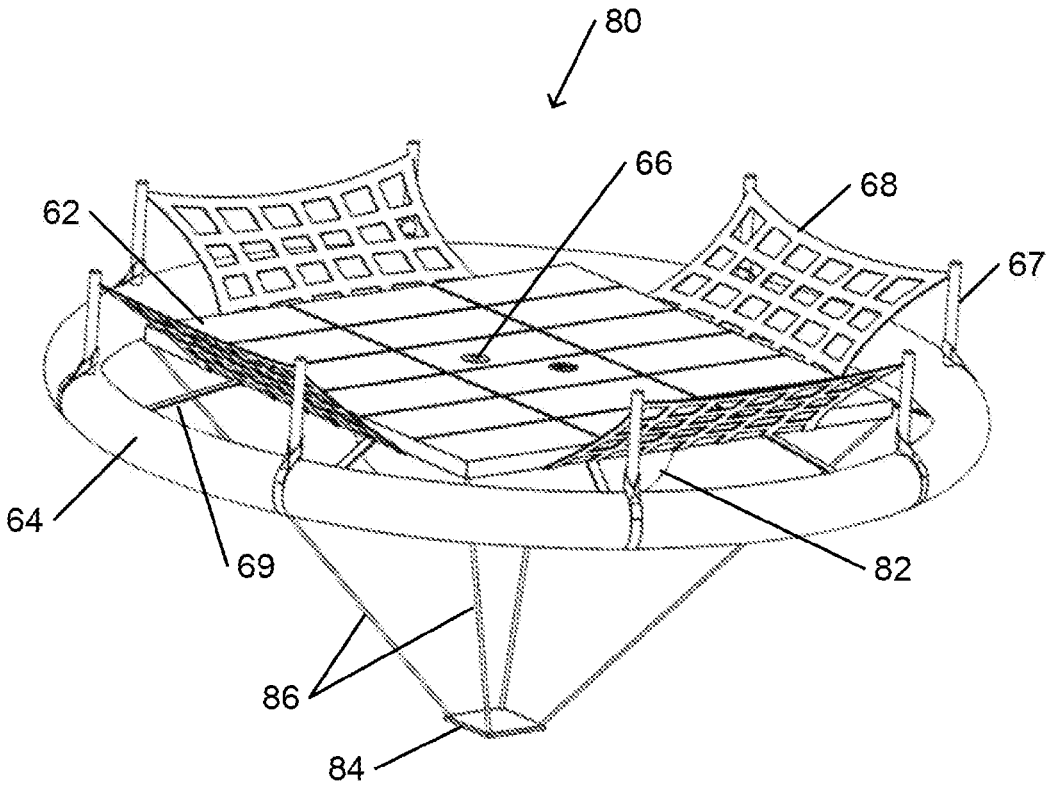
FIG. 5A schematically illustrates variants of the lifesaving module shown in FIG. 4A.
Figure 5B:
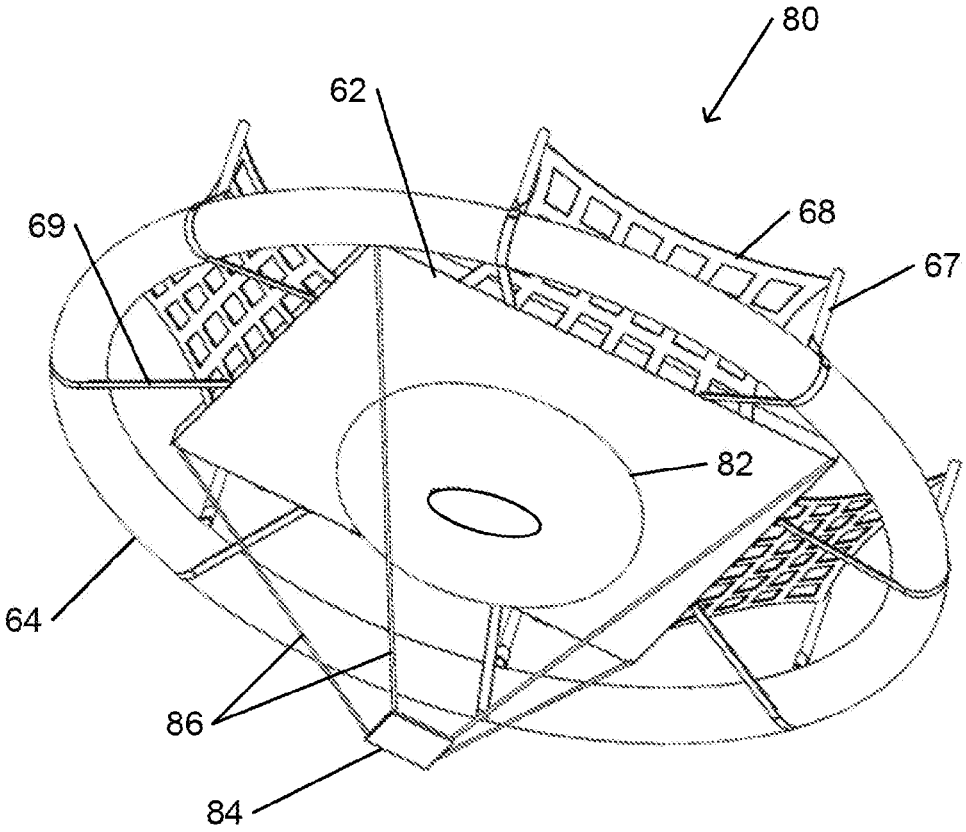
FIG. 5B shows another view of the lifesaving module shown in FIG. 5A.

FIG. 5A schematically illustrates variants of the lifesaving module shown in FIG. 4A. FIG. 5B shows another view of the lifesaving module shown in FIG. 5A.

Lifesaving module 80 includes additional support for a central portion of platform 62 in the form of central inflatable structure 82. For example, central inflatable structure 82 may be in the form of an inflatable ring or toroidal tube, as shown, or may be in another form. For example, central inflatable structure 82 may be configured to inflate when platform 62 rises to the water surface (e.g., as indicated by one or more sensors).

Lifesaving module 80 may include stabilizer 84. Stabilizer 84 may be configured to hang below platform 62 and inflated ring 64. For example, stabilizer 84 may be attached to platform 62 or to inflated ring 64 by connection lines 86 in a symmetric manner, e.g., so as to hang below a center of lifesaving module 80. For example, stabilizer 84 may include a weight that hangs below platform 62. Stabilizer 84 in the form of a weight may function to ensure that a center of gravity of lifesaving module 80 is lower than a center of buoyancy of lifesaving module 80. Alternatively or in addition, stabilizer 84 may be configured (e.g., shaped, oriented, or positioned) so as to generate a drag force that resists tipping of lifesaving module 80. For example, stabilizer 84 may function as a stabilizing fin and may or may not be weighted. Thus, lifesaving module 80 may be stabilized against tipping or capsizing.

In accordance with an embodiment of the present invention, a lifesaving module may be assembled from a plurality of sub-modules.

Figure 6A:
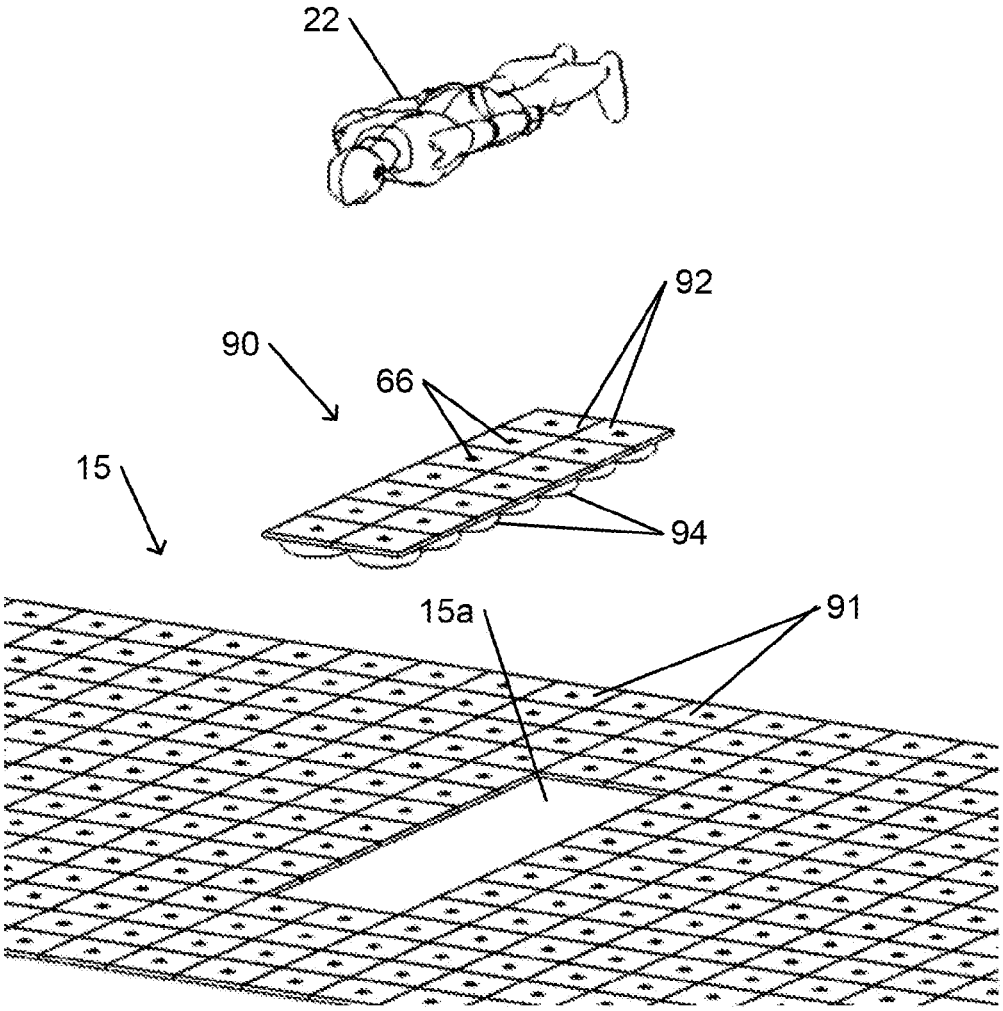
FIG. 6A schematically illustrates a lifesaving module that is assembled from sub-modules, in accordance with an embodiment of the present invention.
Figure 6B:
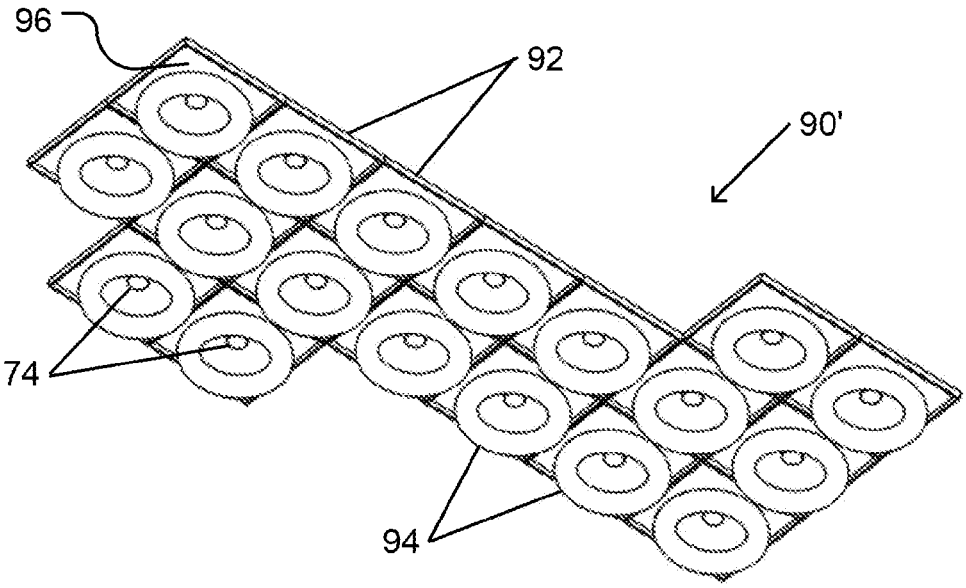
FIG. 6B schematically illustrates a bottom of a lifesaving module that is assembled from sub-modules, in accordance with an embodiment of the present invention.

FIG. 6A schematically illustrates a lifesaving module that is assembled from sub-modules, in accordance with an embodiment of the present invention. FIG. 6B schematically illustrates a bottom of a lifesaving module that is assembled from sub-modules, in accordance with an embodiment of the present invention.

Floor 15 of a swimming pool includes an array of deployable sub-modules 91. In some cases, deployable sub-modules 91 may be connected to adjacent deployable sub-modules 91 when stored on floor 15. Alternatively, deployable sub-modules 91 may be disconnected from other deployable sub-modules 91 when stored on floor 15. Each deployable sub-module 91 includes a module controller 74. Module controller 74 of a deployable sub-module 91 may operate cause deployable sub-module 91 to connect to, or to disconnect from, one or more adjacent deployable sub-modules 91. Module controller 74 may operate to cause a flotation structure 94 of deployable sub-module 91 to inflate or otherwise deploy.

When a swimmer in distress 22 is detected, a plurality of adjacent deployable sub-modules 91 may be assembled and deployed to form assembled lifesaving module 90. For example, deployable sub-modules 91 may be selected to form assembled lifesaving module 90 from a region 15*a* of floor 15 that is shaped similarly to swimmer in distress 22 (e.g., with region 15*a* being directly below and having lateral dimensions that are at least as large as, or larger than, the lateral dimensions of swimmer in distress 22).

For example, during deployment, adjacent selected deployable sub-modules 91 in region 15*a* are connected to one another (e.g., when initially disconnected), or remain connected to one another (when initially connected). Concurrently, any connections between deployable sub-modules 91 within region 15*a* and deployable sub-modules 91 adjacent to region 15*a* are broken.

Deployable sub-modules 91 may be deployed by inflating or otherwise deploying flotation structures 94 to form deployed sub-modules 92. Flotation structure 94 is located beneath each sub-module platform 96. Assembled lifesaving module 90 may then float upward to swimmer in distress 22. Alternate assembled lifesaving module 90' illustrates another configuration of connected deployed sub-modules 92 (e.g., to accommodate a swimmer in distress 22 with extended limbs).

Typically, assembled lifesaving module 90 does not require any additional stabilizing structure. Since each deployed sub-modules 92 includes a separate flotation structure 94, the entire area of assembled lifesaving module 90 may be supported by an approximately uniform buoyant force. Thus, assembled lifesaving module 90 may be stable against tipping and may be rigid against bending under a supported load, such as swimmer in distress 22.

Figure 7:
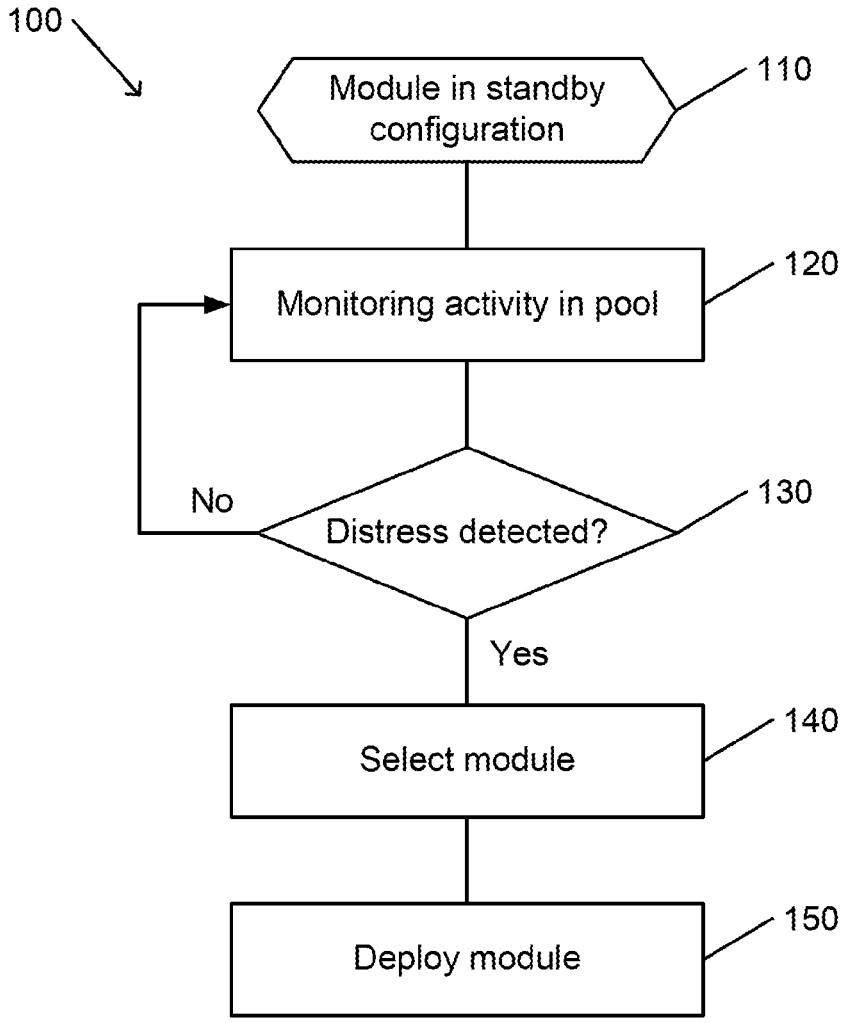
FIG. 7 is a flowchart depicting a method for operation of a swimming pool lifesaving system, in accordance with an embodiment of the present invention.

FIG. 7 is a flowchart depicting a method for operation of a swimming pool lifesaving system, in accordance with an embodiment of the present invention.

It should be understood with respect to any flowchart referenced herein that the division of the illustrated method into discrete operations represented by blocks of the flowchart has been selected for convenience and clarity only. Alternative division of the illustrated method into discrete operations is possible with equivalent results. Such alternative division of the illustrated method into discrete operations should be understood as representing other embodiments of the illustrated method.

Similarly, it should be understood that, unless indicated otherwise, the illustrated order of execution of the operations represented by blocks of any flowchart referenced herein has been selected for convenience and clarity only. Operations of the illustrated method may be executed in an alternative order, or concurrently, with equivalent results. Such reordering of operations of the illustrated method should be understood as representing other embodiments of the illustrated method.

Lifesaving system operation method 100 may be executed by one or more controllers of, or that are associated with, a swimming pool lifesaving system. For example, lifesaving system operation method 100 may be executed automatically, or in response to a command by an operator of the system. For example, execution of lifesaving system operation method 100 may begin at a beginning of a time when a swimming pool is opened to swimmers, and may cease when the swimming pool is closed. In some cases, execution of lifesaving system operation method 100 may be limited to times when a lifeguarding staff is not present or is shorthanded, or when the number of swimmers exceeds a threshold number. Execution of lifesaving system operation method 100 may be activated automatically when the presence of swimmers or bystanders is detected by one or more sensors. In some cases, execution of lifesaving system operation method 100 may be continuous.

Lifesaving system operation method 100 may be executed when one or more lifesaving modules are in a standby configuration (block 110). For example, a lifesaving module in a standby configuration may be deployable in response to an appropriate transmitted signal or command. A lifesaving module in standby configuration may be stowed on or near the bottom of a swimming pool, or elsewhere beneath a typical depth at which a swimmer in distressed may be expected to be detected.

In some cases, an array of sub-modules may be stowed at the bottom of the swimming pool. Each sub-module may include its own inflatable structure and module sensor. Adjacent sub-modules of the array may be interconnected when stowed.

When lifesaving system operation method 100 is being executed, activity in part or all of a swimming pool may be monitored (block 120). For example, one or more imaging devices that are arranged about the pool (e.g., within the pool, outside the pool, or both) may acquire images of activity in the pool in one or more spectral ranges. Image processing techniques, computer vision techniques, both, or additional or other techniques may be applied to identify and track activity of individual swimmers. Alternatively or in addition, sensors may measure one or more qualities or quantities that are related to activity in the pool (e.g., water temperature, waves or splashing, motion, distance or proximity, or another quantity). All or part of the pool may be monitored. For example, monitoring may be limited to a deep end of the pool, to a section of the pool where varied activity or diving takes place (e.g., as opposed to a part of the pool that is reserved for swimmers who are swimming laps), a part with a large concentration of swimmers or children, or another part of the pool.

The monitored activity may be analyzed to determine whether an indication of a swimmer in distress is detected (block 130). For example, detected activity may be compared with one or more predetermined criteria to determine whether a detected activity matches a pattern that is indicative of a swimmer in distress. A model for identifying a swimmer in distress may be built or improved by application of standard computer learning techniques. For example, an operator who is viewing activity in the pool concurrently with the swimming pool lifesaving system may operate a control to confirm or contradict a detection of a swimmer in distress. The system may use such operator input to automatically refine a model for detecting distress.

When no distress is detected, monitoring may continue (returning to block 120). For example, absence of distress may be indicated by such detected activity as regular or directed motion, surfacing at frequent intervals, standing in shallow water, or other activity.

In some cases, the monitored activity may be indicative of a swimmer in distress (block 130). For example, distress may be indicated by irregular motion or flailing in deep water, by lack of movement when a swimmer is completely or partially submerged, by remaining submerged for an excessive period of time, or other indications. Detected motion or other sensed activity may be compared with one or more profiles of activity that had previously been defined as indicative of a swimmer in distress.

When distress is detected, one or more lifesaving modules may be selected for deployment (block 140). In some cases, an alert may be generated prior to, or concurrent with, deployment of the lifesaving module. In some cases, criteria for generation of an alert may be less stringent than for automatic deployment of a module. For example, an alert may be issued when detected activity has a smaller chance of being indicative of distress. Automatic deployment may be limited to activity with a much larger probability of being indicative of stress. If the system is configured to be monitored by one or more operators, the alert may include an indication of a location of the detected swimmer in distress (e.g., with reference to an appropriate coordinate system, e.g., that is marked on the pool or on an image of the pool), an image of the swimmer in distress, both, or other relevant information. Each operator may operate a control to either confirm or contradict the automatic identification of a swimmer in distress.

An appropriate algorithm may be applied to determine a course of action when no instructions or contradictory instructions are received. For example, when one or more operators contradict the identification of distress, deployment of the lifesaving module may be halted or continued, e.g., depending on the likelihood that distress has indeed been identified. If no response is received within a predetermined period of time, deployment may proceed automatically (e.g., if the likelihood of distress is sufficiently high). If contradictory indications are received by one or more operators, the algorithm may be configured to deploy or not deploy in accordance with predetermined criteria (e.g., always deploying or not deploying the module, according to a simple majority of operators or in accordance with a pre-assigned weighting factor for each operator, or another criterion).

The system may apply predetermined criteria in selecting a lifesaving module for deployment. For example, priority may be given to the module that is nearest to the identified swimmer in distress. In some cases, another module may be selected. For example, different modules may be configured to lift and support swimmers of different sizes or weights. In this case, the selected module may be the nearest module that is configured for the size or weight of the swimmer. In some cases, a selection of a module for deployment may be influenced by the presence of other swimmers or objects in the vicinity of the swimmer in distress. For example, if other objects or swimmers are detected between the nearest module and the swimmer in distress, a more distant module with a clear path to the swimmer in distress may be selected.

In some cases, selection of a lifesaving module may include selection of two or more adjacent sub-modules for deploying as a lifesaving module. For example, the sub-modules may be selected so as to approximately match a sensed position, size, and shape of the sensed swimmer in distress. In some cases, prior to deployment, the connections between the selected sub-modules and adjacent non-selected sub-modules may be disconnected (e.g., in response to an appropriate signal from a system controller), while adjacent selected sub-modules remain connected to one another. In some cases, the connections to non-selected sub-modules may be broken during the course of deployment.

The selected lifesaving module may be deployed (block 150).

Deployment of the selected lifesaving module may include triggering inflation of one or more inflatable structures on the module. A chemical process may be triggered to generate a gas for inflating the structure. A valve or seal on a canister of compressed gas may be opened to enable the gas to expand within, and thus inflate, the inflatable structures. The deployment of the module causes the module to rise toward the surface of the water in the pool under the swimmer in distress.

The inflation may be gradual at first in order to enable the selected lifesaving module to rise above the neighboring modules. For example, the gradual initial inflation may prevent the presence of the neighboring modules from interfering with the inflation of the inflatable structure. For example, the inflatable structure may be stowed (e.g., folded, or connected by cords or other structure) such that initial inflation extends the inflatable structure (to form one or more extending "legs") downward toward the bottom of the pool. Thus, the initial inflation may lift the deployed module above the neighboring modules prior to full inflation. The inflation mechanism may be configured such that the initial inflation concurrently extends parts (e.g., the "legs") of the inflating structure downward in an evenly distributed manner (e.g., by concurrent activation of several distributed canisters of compressed gas) in order to prevent tipping or other uneven raising of the module during deployment.

When the lifesaving module is assembled from sub-modules, the initial inflation may raise the selected sub-modules so as to break the connections between the selected sub-modules and the adjacent sub-modules that had not been selected (if these connections had not been disconnected prior to inflation).

One or more guidance devices may be operated to maneuver the module to rise under the swimmer in distress. The guidance devices may be configured to steer the module as it rises, or may be configured to laterally propel the module as it rises. The guidance devices may be operated continuously as the module rises to continuously adjust the lateral position of the module relative to the swimmer (as determined by monitoring one or more position sensors). Alternatively or in addition, a guidance device in the form of a steering device may be set initially, e.g., only at the time of deployment, so as to steer the module passively (e.g., without further adjustment) toward the swimmer as the module rises.

The buoyancy of the deployed module may be sufficient to lift the swimmer in distress above the level of the water. The module may be guided by one or more people (who may not necessarily be trained lifeguards), to the side of the pool where further treatment, resuscitation, or rescue efforts may be applied.

In some cases, the deployed module may operate one or more stabilization devices to prevent tipping of the module either by movement of the supported swimmer in distress, or by activities of other swimmers in the pool.

A lifesaving module prior to deployment may be made compact so as to closely adjoin other lifesaving module. Thus, the lifesaving modules may cover floor of the pool with minimal gaps between adjacent lifesaving modules.

In some cases, flotation structure of the lifesaving module may be inflated mechanically, e.g., by release of an elastic structure, rather than with compressed or pumped air. Thus, the weight and complexity of the lifesaving module need not be increased by a canister of compressed gas, or of chemicals that may react to form a gas. Similarly, the system need not include a pump that actively pumps air to the flotation structure.

Figure 8A:
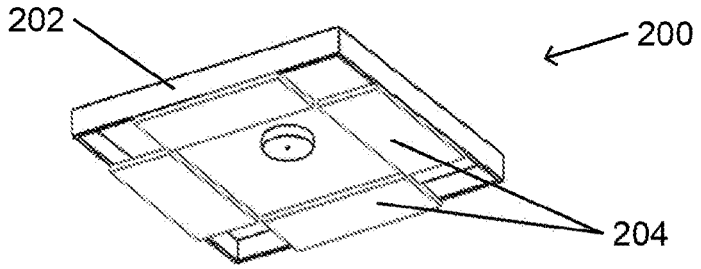
FIG. 8A schematically illustrates a lifesaving module having mechanical flotation structure and prior to deployment, in accordance with an embodiment of the present invention.

FIG. 8A schematically illustrates a lifesaving module having mechanical flotation structure and prior to deployment, in accordance with an embodiment of the present invention.

In lifesaving module 200, platform 202 initially encases flotation structures 204. As shown, elastic flotation structures 204 are in a folded state, lifesaving module 200 may include tubing that is connected to a tube or conduit structure (e.g., located in a floor or wall of a pool) that connects to the ambient atmosphere. Elastic flotation structures 204 may be held in a folded state by a remotely controllable latch, or by similar holding structure.

Figure 8B:
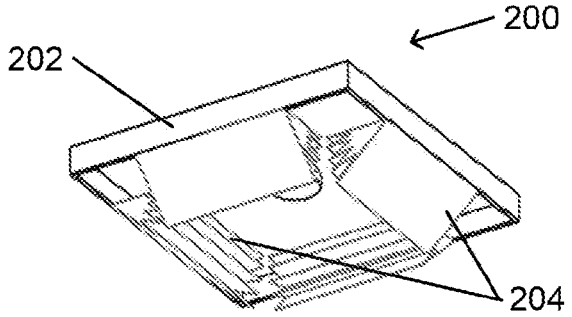
FIG. 8B schematically illustrates initiation of inflation of the mechanical flotation structure of the lifesaving module shown in FIG. 8A.
Figure 8C:
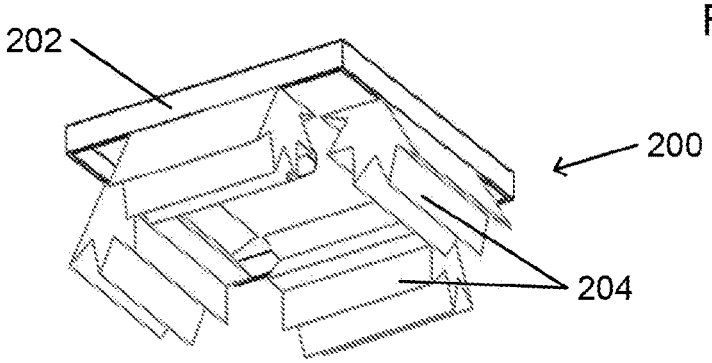
FIG. 8C schematically illustrates further inflation of the mechanical flotation structure shown in FIG. 8B.

FIG. 8B schematically illustrates initiation of inflation of the mechanical flotation structure of the lifesaving module shown in FIG. 8A. FIG. 8C schematically illustrates further inflation of the mechanical flotation structure shown in FIG. 8B.

When elastic flotation structures 204 are to be inflated, a latch that holds elastic flotation structures 204 in a folded state may be released. Resilience structure of elastic flotation structures 204 (e.g., elastic rods, tubes, plates, springs, accordion-folded structure, or other elastic structure, e.g., that are initially compressed or folded) may cause elastic flotation structures 204 to begin to open, as shown. While elastic flotation structures 204 are opening, a conduit or tube may convey air from the ambient atmosphere into elastic flotation structures 204 so as to inflate elastic flotation structures 204.

Figure 8D:
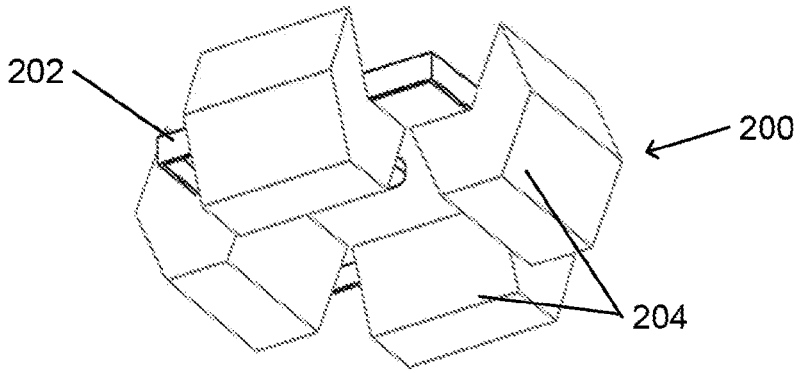
FIG. 8D schematically the mechanical flotation structure of the lifesaving module shown in FIG. 8C as fully inflated.

FIG. 8D schematically the mechanical flotation structure of the lifesaving module shown in FIG. 8C as fully inflated.

The resilient structure of elastic flotation structures 204 may fully open elastic flotation structures 204. The tube structure that connects the interiors of elastic flotation structures 204 to the ambient atmosphere may include a one-way valve. Thus, the air that fills elastic flotation structures 204 when fully open may be prevented from escaping. Thus elastic flotation structures 204 may be maintained in a fully open state and provide buoyancy to lifesaving module 200.

In some cases, the flotation structure may inflate asymmetrically. For example, the flotation structure may surround the platform of the lifesaving module, e.g., in the form of an inflatable ring that is inflated using a source of pressurized air or gas. Restraining structure may be provided to prevent the lifesaving module from floating upward until the flotation structure is completely inflated. Thus, tilting or capsizing of the lifesaving module due to uneven partial inflation may be prevented.

Figure 9:
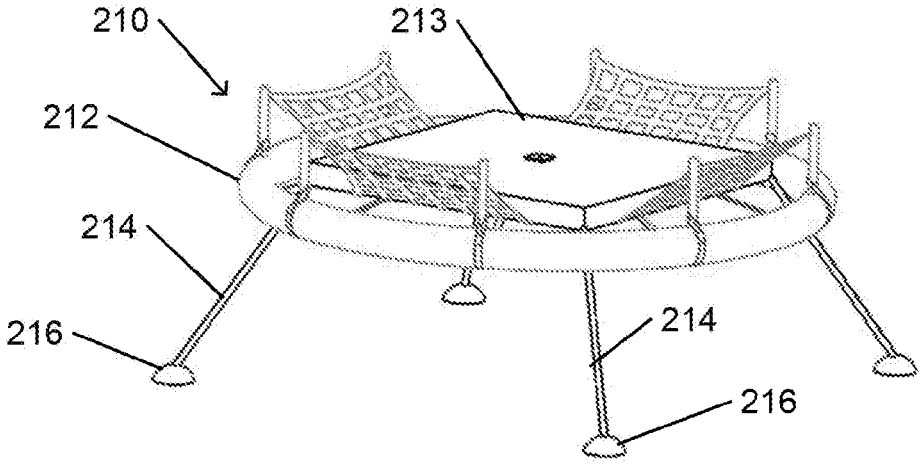
FIG. 9 schematically illustrates structure for restraining a lifesaving module with partially inflated flotation structure, in accordance with an embodiment of the present invention.

FIG. 9 schematically illustrates structure for restraining a lifesaving module with partially inflated flotation structure, in accordance with an embodiment of the present invention.

Lifesaving module 210 (e.g., platform 213 or another part of lifesaving module 210) is connected to a plurality of floor anchors 216 by a corresponding plurality of tethering elements 214. For example, floor anchors 216 may be distributed symmetrically about lifesaving module 210. Tethering elements 214 may include rods, cables, straps, or another type of element that is suitable for connecting lifesaving module 210 to a floor anchor 216.

Floor anchors 216 are each configured to exert a force on the floor of the pool that resists separation of floor anchor 216 from the floor. However, when a maximum separation-resisting force is exceeded, floor anchors 216 may separate from the floor. The combined maximum separation-resisting force of all of floor anchors 216 is selected to be less than the buoyant force on lifesaving module 210 when flotation structure 212 of lifesaving module 210 is fully inflated. For example, floor anchors 216 may be configured to grip the pool floor by suction (e.g., each floor anchor 216 includes a suction cup), by a magnetic force (e.g., between a magnet in floor anchor 216 and a ferromagnetic plate in the floor, or vice versa), by an adhesive, by an element of limited tensile strength, by a friction element (e.g., a projection of floor anchor 216 that fits snugly into a hole in the floor, or vice versa), an clamp or other mechanical gripping mechanism, or another mechanism that may be configured to hold floor anchor 216 held with a force that is limitable to a maximum force.

Thus, when flotation structure 212 begins to inflate, floor anchors 216 and tethering elements 214 prevent lifesaving module 210 from detaching from the floor of the pool. When flotation structure 212 is fully inflated, the buoyant force on lifesaving module 210 that is transmitted to floor anchors 216 by tethering elements 214 may be exceed the maximum separation-resisting force. Thus, when flotation structure 212 is fully inflated, floor anchors 216 may separate from the floor of the pool, enabling the buoyant force to lift lifesaving module 210 toward the water surface of the pool.

A stabilizer for stabilizing a lifesaving module (e.g., by lowering the center of gravity of the lifesaving module to below its center of buoyancy) may be configured to be deployed as the lifesaving module rises from the floor of a pool.

For example, the stabilizer may include a plurality of weighted arms that extend downward from a folded state as the lifesaving module rises from the floor of the pool. For example, the arms may be hinged at a connection of each of the arms to a platform of the lifesaving module.

Figure 10A:
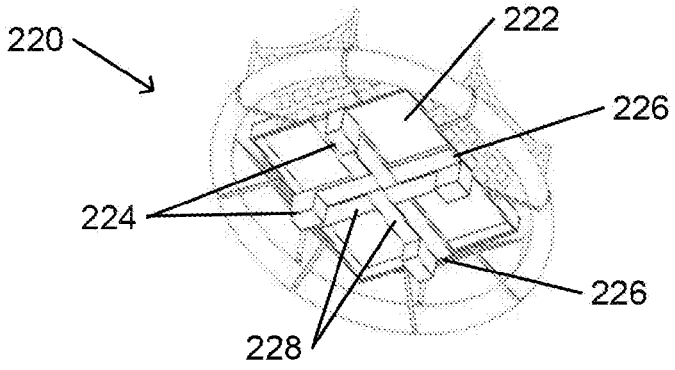
FIG. 10A schematically illustrates folded weighted arms of a stabilizer of a lifesaving module prior to deployment of the arms, in accordance with an embodiment of the present invention.

FIG. 10A schematically illustrates folded weighted arms of a stabilizer of a lifesaving module prior to deployment of the arms, in accordance with an embodiment of the present invention.

When lifesaving module 220 is resting on the floor of the pool, stabilizer arms 228 are folded into or against platform 222. Each stabilizer arm 228 is connected to platform 222 at hinged connection 226.

Figure 10B:
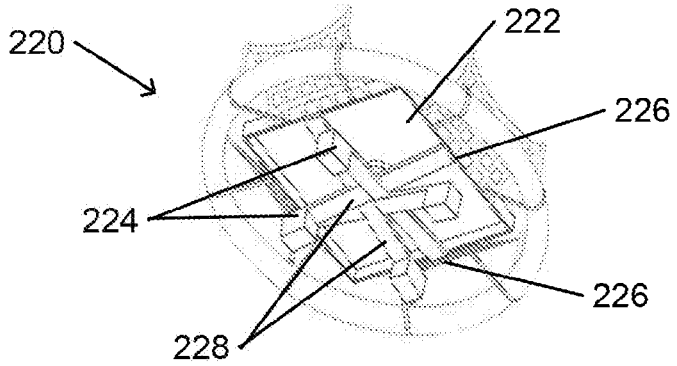
FIG. 10B schematically illustrates the weighted arms shown in FIG. 10A when beginning to deploy.
Figure 10C:
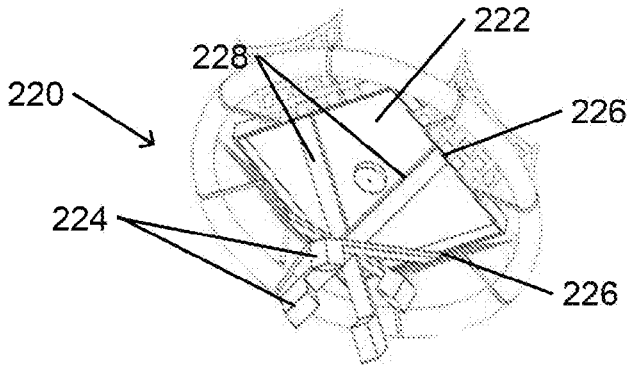
FIG. 10C schematically illustrates further deployment of the weighted arms shown in FIG. 10B.

FIG. 10B schematically illustrates the weighted arms shown in FIG. 10A when beginning to deploy. FIG. 10C schematically illustrates further deployment of the weighted arms shown in FIG. 10B.

As lifesaving module 220 rises from the floor, stabilizing weights 224 at the distal ends of stabilizer arms 228 are pulled downward by gravity. The downward force on stabilizing weights 224 causes each stabilizer arm 228 to rotate downward about hinged connection 226.

Figure 10D:
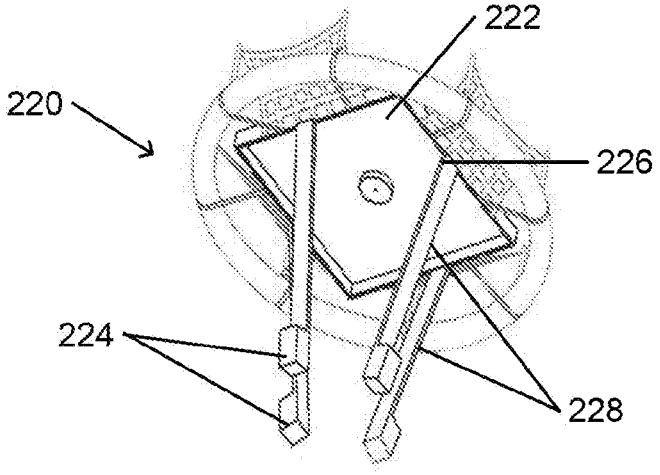
FIG. 10D schematically illustrates the lifesaving module shown in FIG. 10C with the weighted arms fully extended downward.

FIG. 10D schematically illustrates the lifesaving module shown in FIG. 10C with the weighted arms fully extended downward.

When in the configuration shown in FIG. 10D, stabilizing weights 224 hang maximally downward from platform 222. Thus, stabilizing weights 224 may ensure that the center of gravity of lifesaving module 220 is located lower than the center of buoyancy of lifesaving module 220.

In some cases, rigid stabilizer arms 228 may be replaced with flexible cables or straps that enable stabilizing weights 224 to be lowered as lifesaving module 220 rises from the floor of the pool.

As another example, a single stabilizing weight may be attached symmetrically to a platform of the lifesaving module. The attaching structure may be configured to maintain the stabilizing weight at a lateral position that is below the center of gravity of the remainder of the lifesaving module.

Figure 11A:
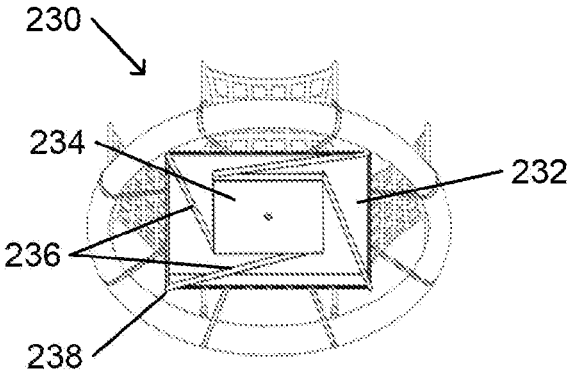
FIG. 11A schematically illustrates a stabilizer weight, prior to deployment, that is constrained to a constant lateral position.

FIG. 11A schematically illustrates a stabilizer weight, prior to deployment, that is constrained to a constant lateral position.

Prior to deployment, stabilizer weight 234 is located within or adjacent to platform 232 of lifesaving module 230. The lateral position of stabilizer weight 234, e.g., of a center of a plate-like stabilizer weight 234, may substantially coincide with a lateral position of the center of gravity of the remainder (e.g., other than stabilizer weight 234) of lifesaving module 230. Stabilizer weight 234 is connected to platform 232 in a symmetric manner (e.g., each corner of a rectangular stabilizer weight 234 to a corresponding corner of a rectangular platform 232, as shown) by rods 236 at rod connections 238.

Figure 11B:
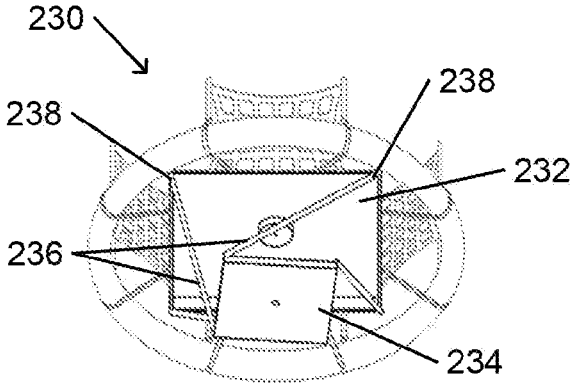
FIG. 11B schematically illustrates deployment of the stabilizer weight shown in FIG. 11A.

FIG. 11B schematically illustrates deployment of the stabilizer weight shown in FIG. 11A.

As lifesaving module 230 rises from the floor of the pool, gravity may begin to lower stabilizer weight 234 from platform 232, extending each rod 236 downward from platform 232. For example, each rod 236 may be configured to rotate in two directions about rod connection 238. The rigidity of rods 236 maintains stabilizer weight 234 in an approximately constant lateral position, e.g., below a center of gravity of the remainder of lifesaving module 230.

Figure 11C:
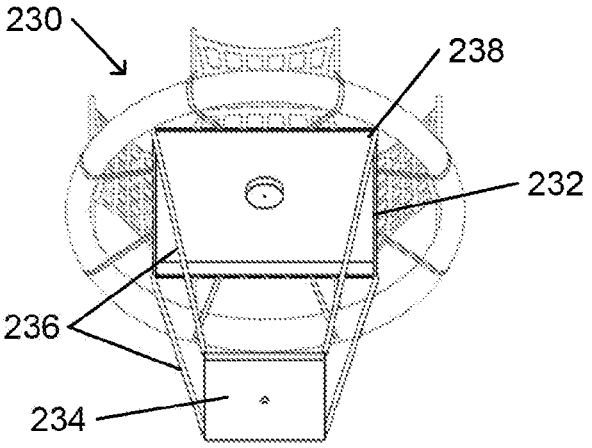
FIG. 11C schematically illustrates full deployment of the stabilizer weight shown in FIG. 11B.

FIG. 11C schematically illustrates full deployment of the stabilizer weight shown in FIG. 11B.

When stabilizer weight 234 is fully deployed, rods 236 extend maximally downward. The lateral position of stabilizer weight 234 is approximately at the lateral position of the center of gravity of lifesaving module 230.

Since a lifesaving module may lie on the floor of a pool when not deployed, users of the pool may be expected to step or rest on a top of on the module (e.g., a platform of the module that forms a top layer of a floor of the pool). A lifesaving module may be configured with structure to support the top of the module prior to deployment, e.g., to prevent damage to the lifesaving module.

Figure 12A:
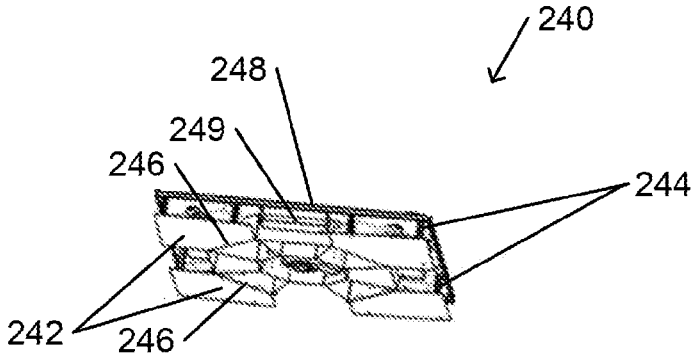
FIG. 12A schematically illustrates a lifesaving module, prior to deployment, that includes support structure.

FIG. 12A schematically illustrates a lifesaving module, prior to deployment, that includes support structure.

Lifesaving module 240 is configured, prior to deployment, to lie on a floor of a pool. When lying of the floor, panels 242 are configured to rest on the floor. Platform 248 is configured to face upward to form a raised floor of the pool. Thus, a user of the pool may step, walk, or rest on, or otherwise apply a downward force on platform 248. Panels 242 are provided with support columns 244. Support columns 244 are configured to extend from panels 242 to platform 248. Thus, support columns 244 may prevent bending, denting, or other damage to platform 248 when a downward force is applied to platform 248.

Flotation structure 249, in a deflated state, may be located between support columns 244.

Figure 12B:
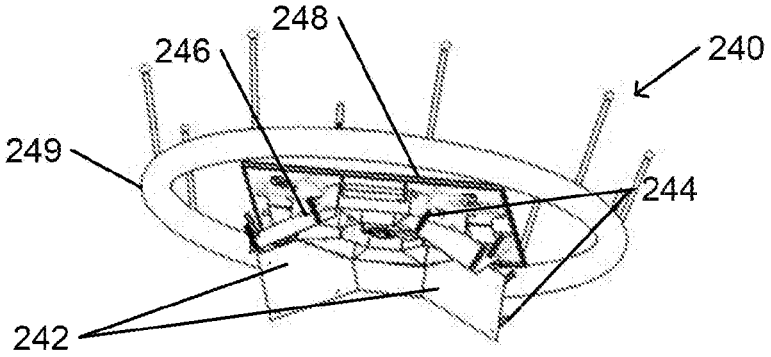
FIG. 12B schematically illustrates deployment of the lifesaving module shown in FIG. 12A.

FIG. 12B schematically illustrates deployment of the lifesaving module shown in FIG. 12A.

As flotation structure 249 begins to inflate, lifesaving module 240 begins to rise from the pool floor. Panels 242 may rotate downward along panel hinges 246. Therefore, flotation structure 249 may inflate freely without interference from support columns 244.

Figure 12C:
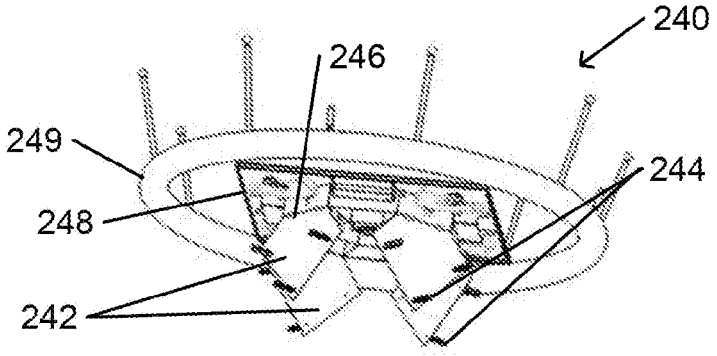
FIG. 12C schematically illustrates the lifesaving module shown in FIG. 12B, fully inflated.

FIG. 12C schematically illustrates the lifesaving module shown in FIG. 12B, fully inflated.

Panels 242 may hang vertically downward from panel hinges 246. In some cases, after rotating downward, panels 242 may function as stabilizing structure for lifesaving module 240.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A lifesaving system for swimmers in a swimming pool filled with water, the lifesaving system comprising:

a plurality of autonomously operated modules arranged in an array of rows and columns, stowed on a floor of the pool, wherein each one of the plurality of modules comprises a flotation structure and is configured to autonomously deploy; and a plurality of sensors configured to monitor activity in the swimming pool and identify a swimmer in distress, wherein at least one module of the plurality of autonomously operated modules stowed substantially beneath the at least one swimmer in distress is deployed, using the flotation structure, by releasing the at least one module of the plurality of autonomously operated modules so as to raise the swimmer to a surface of the water.

2. The lifesaving system of claim 1, wherein the plurality of sensors is positioned below the surface.

3. The lifesaving system of claim 1, wherein the module has a platform configured to support the swimmer.

4. The lifesaving system of claim 1, wherein the at least one module of the plurality of modules comprises an inflatable structure configured to autonomously inflate.

5. The lifesaving system of claim 4, wherein the inflatable structure is situated within a platform of the at least one module.

6. The lifesaving system of claim 4, wherein the inflatable structure is mechanically inflatable.

7. The lifesaving system of claim 3, wherein the at least one module of the plurality of modules further comprises at least one module-sensor for sensing a position of the swimmer relative to the platform.

8. The lifesaving system of claim 1, wherein the at least one module of the plurality of modules further comprises a guidance device for guiding the module laterally beneath the swimmer.

9. The lifesaving system of claim 8, wherein the guidance device further comprises a steering device and a propulsion device.

10. The lifesaving system of claim 3, wherein the at least one module of the plurality of modules further comprises inflatable structure configured to support a central portion of the platform.

11. The lifesaving system of claim 3, wherein the at least one module of the plurality of modules further comprises a stabilization device adapted to prevent tipping of the platform.

12. The lifesaving system of claim 11, wherein the stabilization device is selected from the group consisting of an inflatable bladder, a propulsion device, an extendible counterweight, a plurality of hinged weighted arms, and any combination thereof.

13. The lifesaving system of claim 11, the at least one module of the plurality of modules further comprises a tipping-sensor.

14. The lifesaving system of claim 1, wherein the at least one module of the plurality of modules further comprises a platform for supporting the swimmer in distress and a barrier that that is deployable by inflation of an inflatable structure and at least partially surrounds the platform.

15. The lifesaving system of claim 1, wherein the at least one module of the plurality of modules is capable of selectively connecting to at least one neighboring module.

16. The lifesaving system of claim 1, further comprising a controller configured to deploy at least one module of the plurality of modules in accordance with activity of the swimmers that is monitored.

17. The lifesaving system of claim 16, wherein the controller is further configured to stow the at least one module in accordance with activity of the swimmers that is monitored.

18. A method of employing the lifesaving system of claim 1 comprising:

providing a plurality of autonomously operated modules arranged in an array of rows and columns stowed on a floor of the pool, wherein each one of the plurality of modules comprises a flotation structure and is configured to autonomously deploy;

operating the plurality of sensors so as to monitor activity in the swimming pool;

identifying a swimmer in distress;

selecting at least one module of the plurality of modules that is stowed substantially beneath the swimmer; and deploying only the at least one module that is selected using the flotation structure, by releasing said at least one module, so as to raise the swimmer in distress to the surface.

19. The method of claim 18, wherein said selecting at least one module further comprises selecting at least one additional module that neighbors the at least one module.

20. The method of claim 18, wherein said deploying only the at least one module is selected from the group consisting of inflating an inflatable structure of the module, selectively connecting to at least one neighboring module, and a combination thereof.

21. The method of claim 18, wherein deploying only the at least one module that is selected comprising laterally guiding the module to substantially beneath the swimmer in distress before the module meets the swimmer.

* * * * *